US009205641B2

(12) United States Patent
Hirano et al.

(10) Patent No.: US 9,205,641 B2
(45) **Date of Patent: *Dec. 8, 2015**

(54) INK FILM THICKNESS DISTRIBUTION CORRECTION METHOD AND APPARATUS

(71) Applicant: KOMORI CORPORATION, Tokyo (JP)

(72) Inventors: Masahiro Hirano, Ibaraki (JP); Keiichi Hosaki, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/077,111

(22) Filed: Nov. 11, 2013

(65) Prior Publication Data

US 2014/0130690 A1 May 15, 2014

(30) Foreign Application Priority Data

Nov. 12, 2012 (JP) ..... 248122/2012

(51) Int. Cl.

| | |
|---|---|
| ***B41F 31/20*** | (2006.01) |
| ***B41F 31/04*** | (2006.01) |
| ***B41F 31/30*** | (2006.01) |
| ***B41F 33/00*** | (2006.01) |
| ***B41F 33/10*** | (2006.01) |

(52) U.S. Cl.

CPC ..... *B41F 31/04* (2013.01); *B41F 31/045* (2013.01); *B41F 31/301* (2013.01); *B41F 33/0045* (2013.01); *B41F 33/10* (2013.01); *B41P 2233/11* (2013.01)

(58) Field of Classification Search

CPC ..... B41F 31/302; B41F 31/301; B41F 31/10; B41F 31/045; B41F 31/20; B41F 33/0045; B41F 35/04; B41P 2233/11

USPC ..... 101/351.1–351.4, 352.01–352.05, 365, 101/425, 484, DIG. 47

See application file for complete search history.

(56) References Cited

U.S. PATENT DOCUMENTS

| | | | | | |
|---|---|---|---|---|---|
| 3,701,316 | A | * | 10/1972 | Sylvester et al. | 101/148 |
| 4,882,991 | A | * | 11/1989 | Simeth | 101/350.2 |
| 5,365,849 | A | * | 11/1994 | Spiegel | 101/423 |
| 6,116,161 | A | * | 9/2000 | Voge et al. | 101/483 |

(Continued)

FOREIGN PATENT DOCUMENTS

| | | |
|---|---|---|
| CN | 101992587 | 3/2011 |
| CN | 102991119 | 9/2011 |

(Continued)

*Primary Examiner* — Daniel J Colilla
*Assistant Examiner* — Leo T Hinze
(74) *Attorney, Agent, or Firm* — Blakely Sokoloff Taylor & Zafman LLP

(57) ABSTRACT

In an ink film thickness distribution correction method in an ink supply apparatus including an ink fountain, a plurality of ink fountain keys, an ink fountain roller, an ink ductor roller, and an ink roller group including at least one ink form roller, the throw-off operation of the ink form roller positioned at the end of the ink roller group is performed during test printing or final printing. The ink feed operation of the ink ductor roller is stopped during test printing or final printing. The ink roller group is divided into a plurality of roller subgroups during test printing or final printing. The ink in some roller subgroups out of the divided roller subgroups is scraped and removed by an ink scraping member. An ink film thickness distribution correction apparatus is also disclosed.

3 Claims, 33 Drawing Sheets

(56) References Cited

U.S. PATENT DOCUMENTS

| | | | | |
|---|---|---|---|---|
| 6,615,728 | B2 * | 9/2003 | Kurata et al. | 101/484 |
| 6,712,002 | B2 * | 3/2004 | Herbst et al. | 101/351.1 |
| 8,201,903 | B2 * | 6/2012 | Hirano | 347/7 |
| 2007/0022888 | A1 * | 2/2007 | Inde et al. | 101/365 |
| 2011/0032289 | A1 | 2/2011 | Hirano | |
| 2013/0061768 | A1 | 3/2013 | Hirano et al. | |
| 2013/0061769 | A1 | 3/2013 | Hirano et al. | |
| 2014/0130689 | A1 | 5/2014 | Hirano et al. | |

FOREIGN PATENT DOCUMENTS

| | | | |
|---|---|---|---|
| CN | 102991120 | | 9/2011 |
| CN | 103802464 | | 5/2014 |
| EP | 2 284 008 | A1 | 2/2011 |
| EP | 2 567 817 | A2 | 3/2013 |
| JP | S58-201008 | A | 11/1983 |
| JP | S58-201010 | A | 11/1983 |
| JP | H10-016193 | A | 1/1998 |
| JP | H11-188844 | A | 7/1999 |
| JP | 2003-001797 | A | 1/2003 |

* cited by examiner

INK FILM THICKNESS DISTRIBUTION CORRECTION METHOD AND APPARATUS

BACKGROUND OF THE INVENTION

The present invention relates to an ink film thickness distribution correction method and apparatus for correcting an ink film thickness distribution formed in an ink roller group in an ink supply apparatus.

FIG. 13 shows the main part of an inker (ink supply apparatus) in a printing unit of each color in a web offset printing press. In FIG. 13, the inker includes an ink fountain 1, an ink 2 stored in the ink fountain 1, an ink fountain roller 3, a plurality of ink fountain keys 4 (4-1 to **4-*n*) juxtaposed in the axial direction of the ink fountain roller 3, an ink ductor roller 5, an ink roller group 6, a printing plate 7, and a plate cylinder 8 on which the printing plate 7 is mounted. An image is printed on the printing plate 7. The ink fountain 1, ink fountain roller 3, ink fountain keys 4, ink ductor roller 5, and ink roller group 6 form an ink supply path for supplying ink in the ink fountain 1 to the printing plate 7**.

In the ink supply apparatus, the ink 2 in the ink fountain 1 is supplied to the ink fountain roller 3 by adjusting the opening degrees of the ink fountain keys 4-1 to **4-*n*. The ink supplied to the ink fountain roller 3 is supplied to the printing plate 7 via the ink roller group 6 by the ink feed operation of the ink ductor roller 5. The ink supplied to the printing plate 7 is printed on a printing sheet via a blanket cylinder (not shown). Note that ink form rollers 6-1 to 6-4 in contact with the printing plate 7 are arranged at the end of the ink flow path of the ink roller group 6**.

FIG. 14 shows a printing product printed by the printing press. A band-shaped color bar 9-2 is printed in a margin except for an image region 9-1. In general four-color printing, the color bar 9-2 is formed from regions S1 to Sn each including black, cyan, magenta, and yellow density measurement patches (solid patches with 100% dot area) **9*a*1, 9*a*2, 9*a*3, and 9*a*4. The regions S1 to Sn correspond to the key zones of the ink fountain keys 4-1 to 4-*n*** in printing units of respective colors in the printing press.

[Color Matching]

Reference density values are set in advance for printing units of respective colors. More specifically, reference density values are set in advance for black, cyan, magenta, and yellow. When printing a printing product 9, color matching work is performed to make the density values of the respective colors match their reference density values. An ink supply amount control apparatus (not shown) performs this color matching work during test printing or final printing based on the densities of density measurement patches **9*a* (9*a*1, 9*a*2, 9*a*3, and 9*a*4) of the respective colors on the color bar 9-2 printed on the printing product 9**.

For example, the region S1 on the printing product 9 will be explained as a representative. The density value of the density measurement patch **9*a* of each color of the printing product 9 obtained by test printing or final printing is measured. The density difference between the measured density value of each color and a preset reference density value of this color is obtained. From the obtained density difference of each color, the correction amount (correction amount of the ink supply amount to the region S1) of the opening ratio of the ink fountain key 4-1 in the printing unit of this color is obtained. The opening ratio of the ink fountain key 4-1** in the printing unit of each color is adjusted using the obtained correction amount as a feedback amount.

As for the regions S2 to Sn, the correction amounts (correction amounts of the ink supply amounts to the regions S2 to Sn) of the opening ratios of the ink fountain keys 4-2 to **4-*n* in the printing units of the respective colors are obtained in the same way. The opening ratios of the ink fountain keys 4-2 to 4-*n* in the printing units of the respective colors are adjusted using the obtained correction amounts as feedback amounts. Immediately after the opening ratios of the ink fountain keys 4-1 to 4-*n*** are adjusted, printing restarts. This operation is repeated until the density values of the respective colors reach their reference density values.

However, in this ink supply amount adjustment method, when the density of a printing product becomes excessively high during test printing or final printing, excessive ink in the ink supply apparatus hardly decreases by only decreasing the opening ratio of the ink fountain key. Many wasted sheets are generated, wasting printing materials. In addition, time is taken, decreasing the operation rate.

To efficiently correct an ink film thickness distribution in the ink supply apparatus during test printing or final printing, there have been proposed an ink film thickness correction method disclosed in Japanese Patent Laid-Open No. 10-16193 (literature 1), and an ink film thickness control method disclosed in Japanese Patent Laid-Open No. 11-188844 (literature 2).

[Ink-Decrease+Pre-Inking 2]

In the ink film thickness correction method described in literature 1, when correcting an ink film thickness distribution in the ink supply apparatus during test printing or final printing, the ink feed operation of the ink ductor roller 5 is stopped. In this state, a predetermined number of sheets are printed (blank sheet printing), decreasing ink in the ink supply apparatus (ink-decrease). A minimum ink film thickness distribution Ma (see FIG. 15A) which thins from the upstream side to downstream side of the ink roller group 6 and is required during printing, that is, an ink film thickness distribution Ma corresponding to an image-free portion of the printing plate 7 remains. Then, a modified ink film thickness distribution Mb (see FIG. 15B) is superposed on the remaining ink film thickness distribution Ma (pre-inking 2).

[Pre-Inking(−)=Ink Return to Fountain+Pre-Inking 1]

In the ink film thickness control method described in literature 2, when correcting an ink film thickness distribution in the ink supply apparatus during test printing or final printing, the opening ratios of all the ink fountain keys 4-1 to **4-*n* are set to 0. In this state, the ink feed operation of the ink ductor roller 5 is performed by a predetermined number of times, returning all ink remaining in the ink supply apparatus to the ink fountain 1 ("ink return to fountain"). After that, a minimum ink film thickness distribution Ma (see FIG. 15A) required during printing is formed in the ink roller group 6 (first step of pre-inking 1). A modified ink film thickness distribution Mb (see FIG. 15B) is superposed on the formed ink film thickness distribution Ma (second step of pre-inking 1**).

However, the ink film thickness control method described in literature 1 wastes sheets because blank sheet printing is executed when leaving the ink film thickness distribution Ma on the ink roller group 6.

The ink film thickness control method described in literature 2 takes time because all ink on the ink roller group 6 is returned to the ink fountain 1 and an ink film thickness distribution (Ma+Mb) modified from 0 is formed. In this method, emulsified ink (ink kneaded with damping water) is returned to the ink fountain 1. A printing trouble may occur, wasting printing materials.

SUMMARY OF THE INVENTION

The present invention provides an ink film thickness distribution forming method and apparatus capable of correcting an ink film thickness distribution formed in an ink roller group within a short time without performing blank sheet printing or "ink return to fountain" during test printing or final printing.

To achieve the above object, according to the present invention, there is provided an ink film thickness distribution correction method in an ink supply apparatus, comprising the steps of performing a throw-off operation of an ink form roller positioned at an end of an ink roller group during test printing or final printing, stopping an ink feed operation of an ink ductor roller during test printing or final printing, dividing the ink roller group into a plurality of roller subgroups during test printing or final printing, and scraping and removing the ink in some roller subgroups out of the divided roller subgroups by an ink scraping member.

Also, according to the present invention, there is provided an ink film thickness distribution correction apparatus in an ink supply apparatus, comprising disconnection means for disconnecting the ink roller group from an ink supply path extending from an ink fountain to a printing plate by performing a throw-off operation of an ink form roller positioned at an end of an ink roller group during test printing or final printing and stopping an ink feed operation of an ink ductor roller, and, division means for dividing the ink roller group into a plurality of roller subgroups, and ink removal means for scraping and removing, by an ink scraping member, the ink in some roller subgroups out of the roller subgroups divided by the division means.

According to the present invention, ink in some roller subgroups is scraped and removed by a blade, scraper, or the like. An ink film thickness distribution formed in an ink roller group can be corrected within a short time without performing blank sheet printing or "ink return to fountain" during test printing or final printing.

DESCRIPTION OF THE PREFERRED EMBODIMENT

Figure 1:
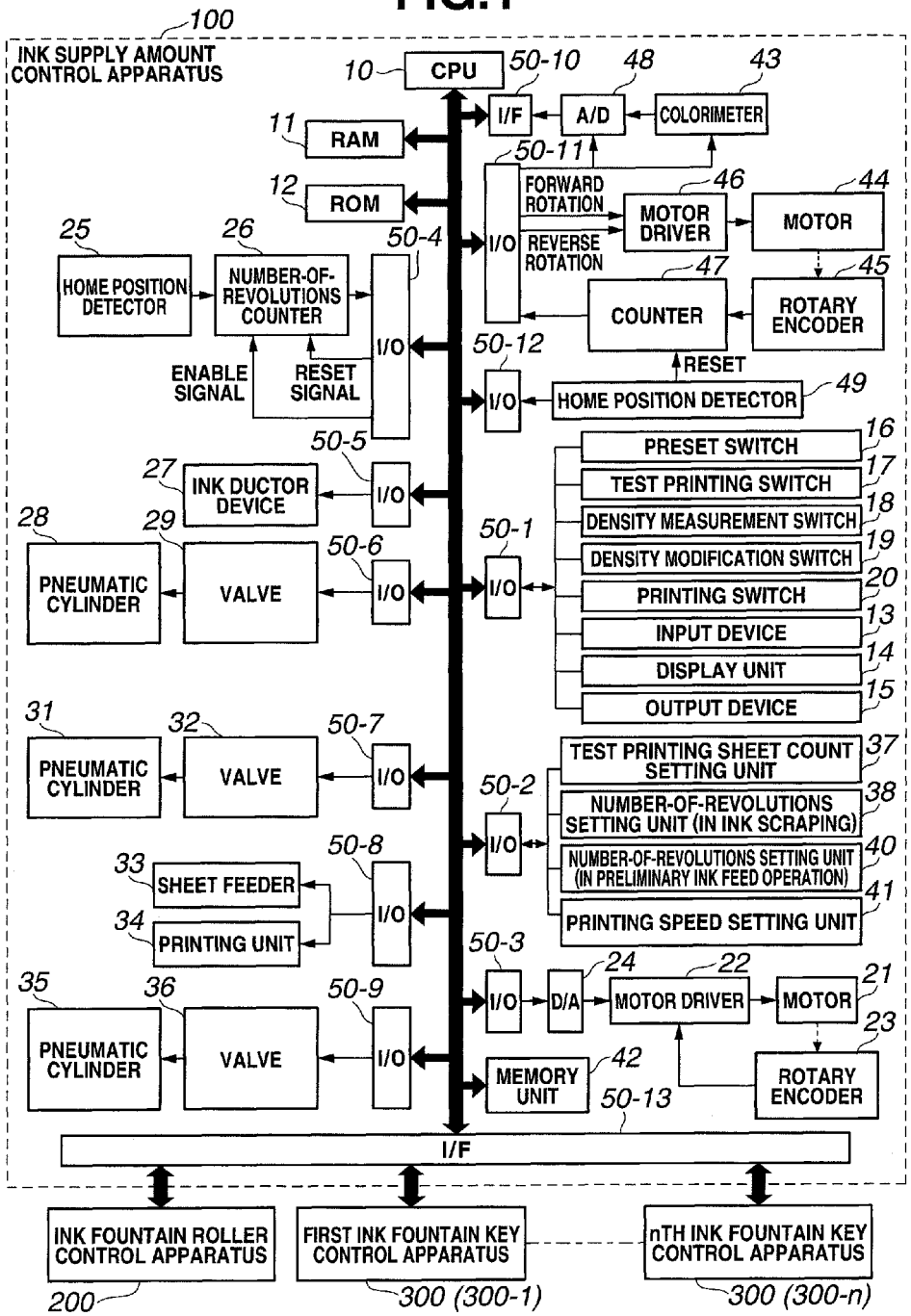
FIG. 1 is a block diagram showing an embodiment of an ink supply amount control apparatus used to practice an ink film thickness distribution correction method according to the present invention.

The present invention will be described in detail below with reference to the accompanying drawings.

An ink supply amount control apparatus 100 includes a CPU 10, a RAM 11, a ROM 12, an input device 13, a display unit 14, an output device (e.g., printer) 15, a preset start switch 16, a test printing start switch 17, a density measurement switch 18, a density modification switch 19, a printing start switch 20, a printing press drive motor 21, a drive motor driver 22, a drive motor rotary encoder 23, a D/A converter 24, a printing press home position detector 25, a counter 26 for counting the number of revolutions of a printing press, and an ink ductor device 27.

The ink supply amount control apparatus 100 includes a roller group division/coupling pneumatic cylinder 28, a roller group division/coupling pneumatic cylinder valve 29, an ink scraping blade throw-on/off pneumatic cylinder 31, an ink scraping blade throw-on/off pneumatic cylinder valve 32, a sheet feeder 33, a printing unit 34, an ink form roller throw-on/off pneumatic cylinder 35, an ink form roller throw-on/off pneumatic cylinder valve 36, a test printing sheet count setting unit 37, a number-of-revolutions setting unit 38 in ink scraping, a number-of-revolutions setting unit 40 in a preliminary ink feed operation, a printing speed setting unit 41, and a memory unit 42.

The ink supply amount control apparatus 100 further includes a colorimeter 43, a colorimeter moving motor 44, a colorimeter moving motor rotary encoder 45, a colorimeter moving motor driver 46, a current colorimeter position detection counter 47, an A/D converter 48, a colorimeter home position detector 49, and input/output interfaces (I/O I/Fs) 50-1 to 50-13.

Figure 2:
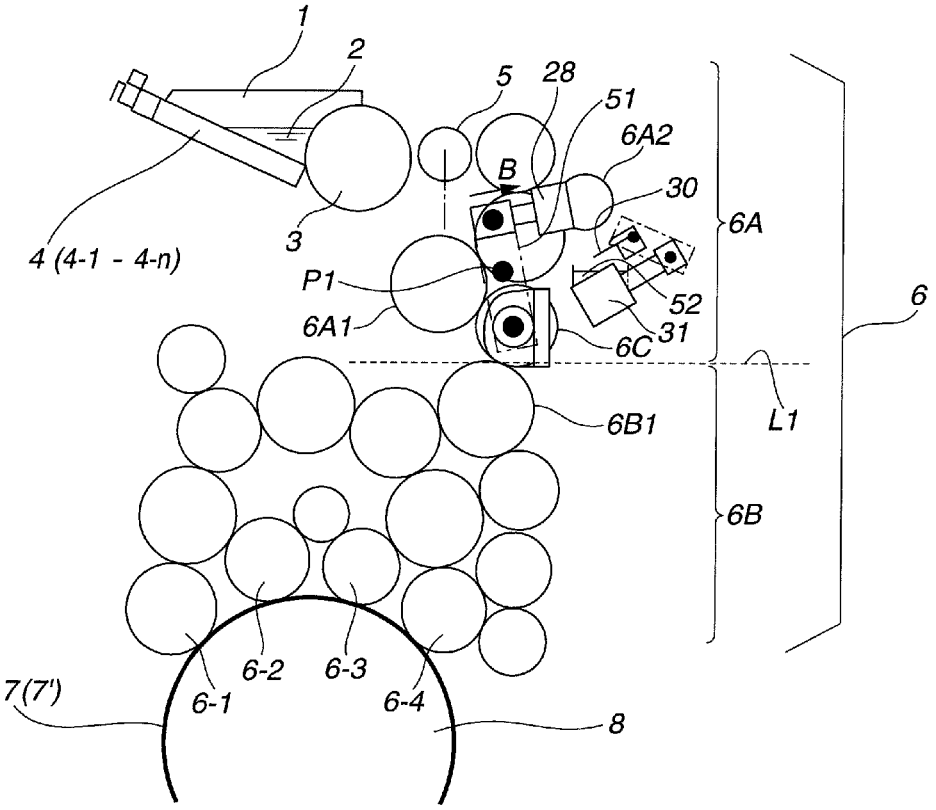
FIG. 2 is a view showing the main part (state in which an ink roller group is coupled (state before dividing the ink roller group)) of an ink supply apparatus in a printing unit to be controlled by the ink supply amount control apparatus.
Figure 13:
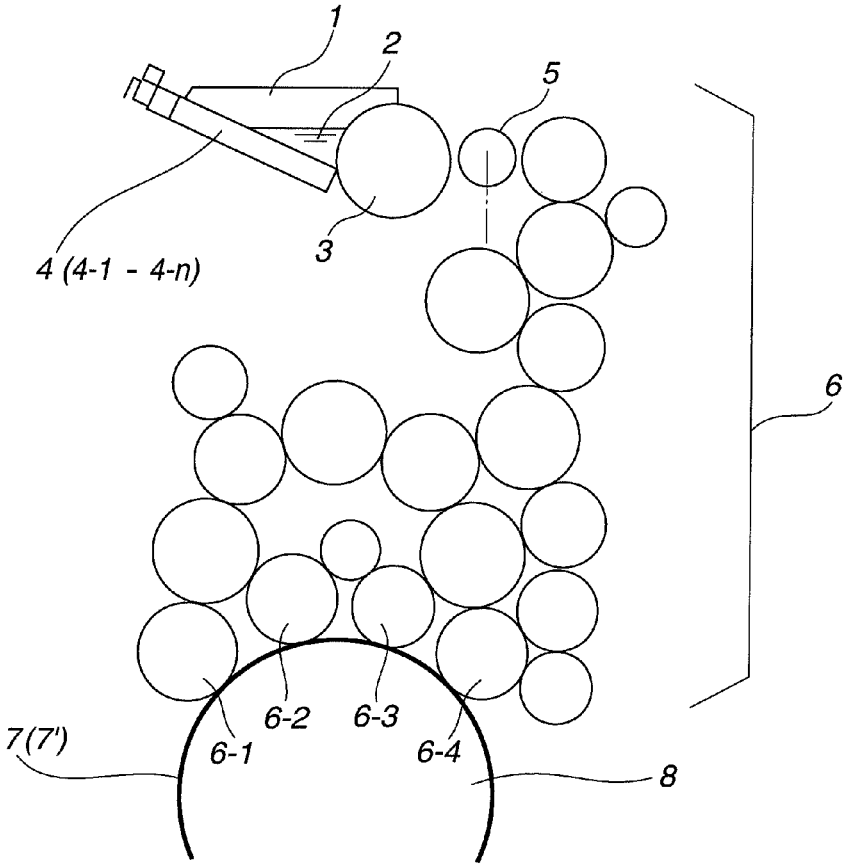
FIG. 13 is a view showing the main part of an ink supply apparatus in a printing unit of each color in a printing press.
Figure 14:
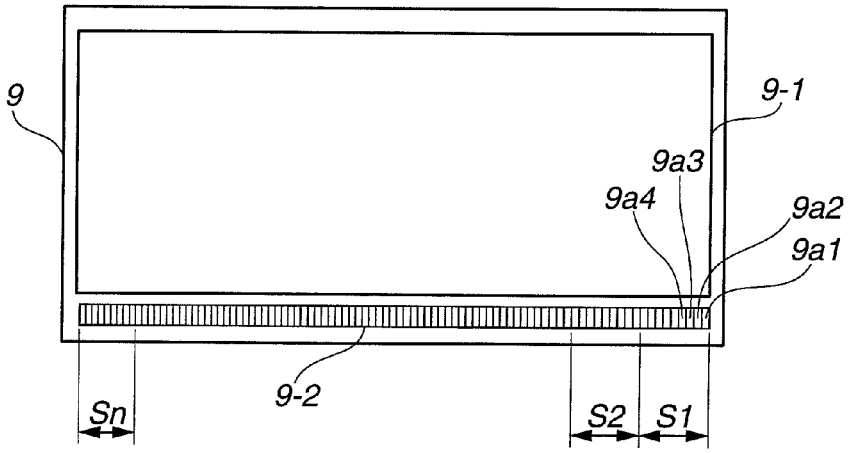
FIG. 14 is a plan view schematically showing a printing product printed by the printing press.
Figure 15A:
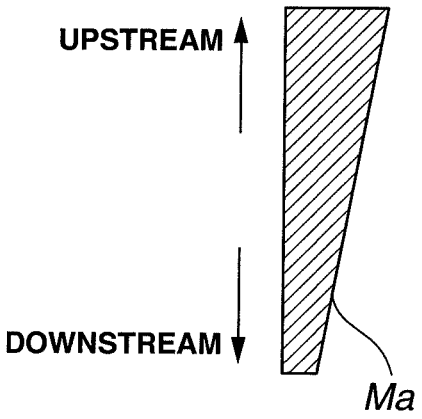
FIGS. 15A and 15B are views showing ink film thickness distributions Ma and Mb formed on the ink roller group of the ink supply apparatus.
Figure 15B:
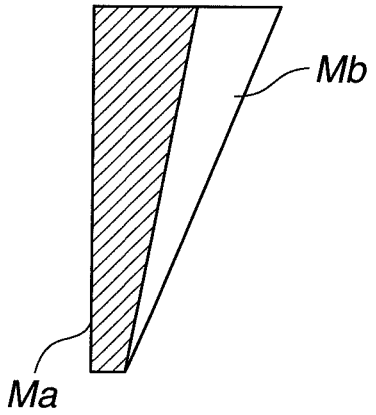

In FIG. 2, the same reference numerals as those in FIG. 13 denote the same or similar parts as those shown in FIG. 13, and a description thereof will not be repeated. In an ink supply apparatus shown in FIG. 2, an ink roller group 6 can be divided into an upstream roller subgroup 6A and downstream roller subgroup 6B at the boundary of a dotted line L1 in FIG. 2.

More specifically, a roller 6C positioned between the upstream roller subgroup 6A and the downstream roller subgroup 6B is axially supported by one end of a swing arm 51 which swings about a fulcrum P1 serving as the pivot center. The roller group division/coupling pneumatic cylinder 28 is coupled to the other end of the swing arm 51. Note that the swing arm 51 is indicated by a chain line in order to individualize it.

Figure 3:
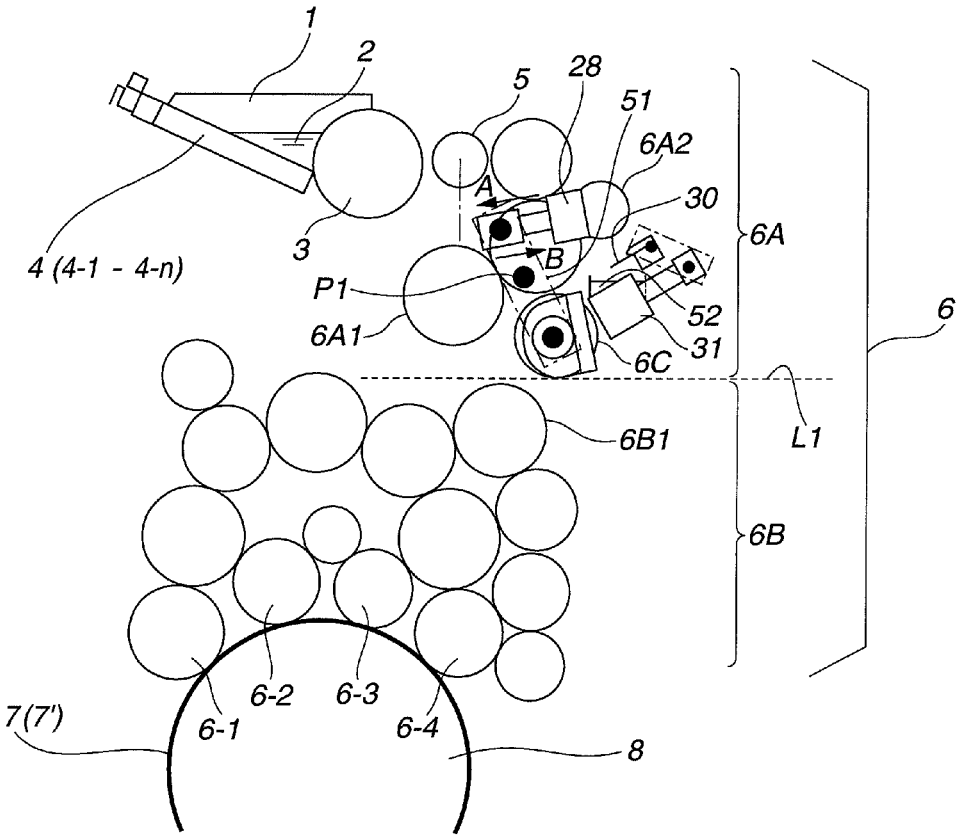
FIG. 3 is a view showing the main part (state in which the ink roller group is divided) of the ink supply apparatus in the printing unit to be controlled by the ink supply amount control apparatus.

In this structure, when the pneumatic cylinder 28 extends (see FIG. 3), the swing arm 51 swings in a direction indicated by an arrow A about the fulcrum P1 serving as the pivot center. As the swing arm 51 swings, the outer surface of the roller 6C moves apart from that of a roller 6A1 positioned at the lowermost end of the ink flow path of the upstream roller subgroup 6A. At the same time, the outer surface of the roller 6C moves apart from that of a roller 6B1 positioned at the uppermost end of the ink flow path of the downstream roller subgroup 6B. As a result, the ink roller group 6 is divided into the upstream roller subgroup 6A and downstream roller subgroup 6B.

When the pneumatic cylinder 28 contracts from this state, the swing arm 51 swings in a direction indicated by an arrow B about the fulcrum P1 serving as the pivot center. As the swing arm 51 swings, the outer surface of the roller 6C comes into contact with that of the roller 6A1 positioned at the lowermost end of the ink flow path of the upstream roller subgroup 6A. At the same time, the outer surface of the roller 6C comes into contact with that of the roller 6B1 at the uppermost end of the ink flow path of the downstream roller subgroup 6B (see FIG. 2). Accordingly, the upstream roller subgroup 6A and downstream roller subgroup 6B are coupled and returned to the single ink roller group 6.

An ink scraping blade 30 which comes into contact with the outer surface of a roller 6A2 of the upstream roller subgroup 6A to scrape ink in the upstream roller subgroup 6A, and an ink receiver 52 which recovers ink scraped by the ink scraping blade 30 are arranged near the ink roller group 6. An ink scraping blade throw-on/off pneumatic cylinder 31 is arranged to be coupled to the ink scraping blade 30. When scraping ink, the pneumatic cylinder 31 contracts to bring the ink scraping blade 30 into contact with the outer surface of the roller 6A2 (see FIG. 4). When the pneumatic cylinder 31 extends, the ink scraping blade 30 moves apart from the outer surface of the roller 6A2.

In FIG. 1, the CPU 10 obtains various kinds of information input via the interfaces 50-1 to 50-13. While accessing the RAM 11 and memory unit 42, the CPU 10 operates in accordance with a program stored in the ROM 12.

The rotary encoder 23 generates a rotation pulse at every predetermined rotation angle of the motor 21, and outputs it to the motor driver 22. The printing press home position detector 25 detects a home position in every rotation of the printing press, generates a home position detection signal, and outputs it to the counter 26.

The ink ductor device 27 is arranged for the ink ductor roller 5. When the ink ductor device 27 is turned on, the ink feed operation of the ink ductor roller 5 starts. When the ink ductor device 27 is turned off, the ink feed operation of the ink ductor roller 5 stops. The pneumatic cylinder 35 is arranged for ink form rollers 6-1 to 6-4. When the pneumatic cylinder 35 extends, the ink form rollers 6-1 to 6-4 are thrown on (come into contact with a printing plate 7). When the pneumatic cylinder 35 contracts, the ink form rollers 6-1 to 6-4 are thrown off (move apart from the printing plate 7).

Figure 5A:
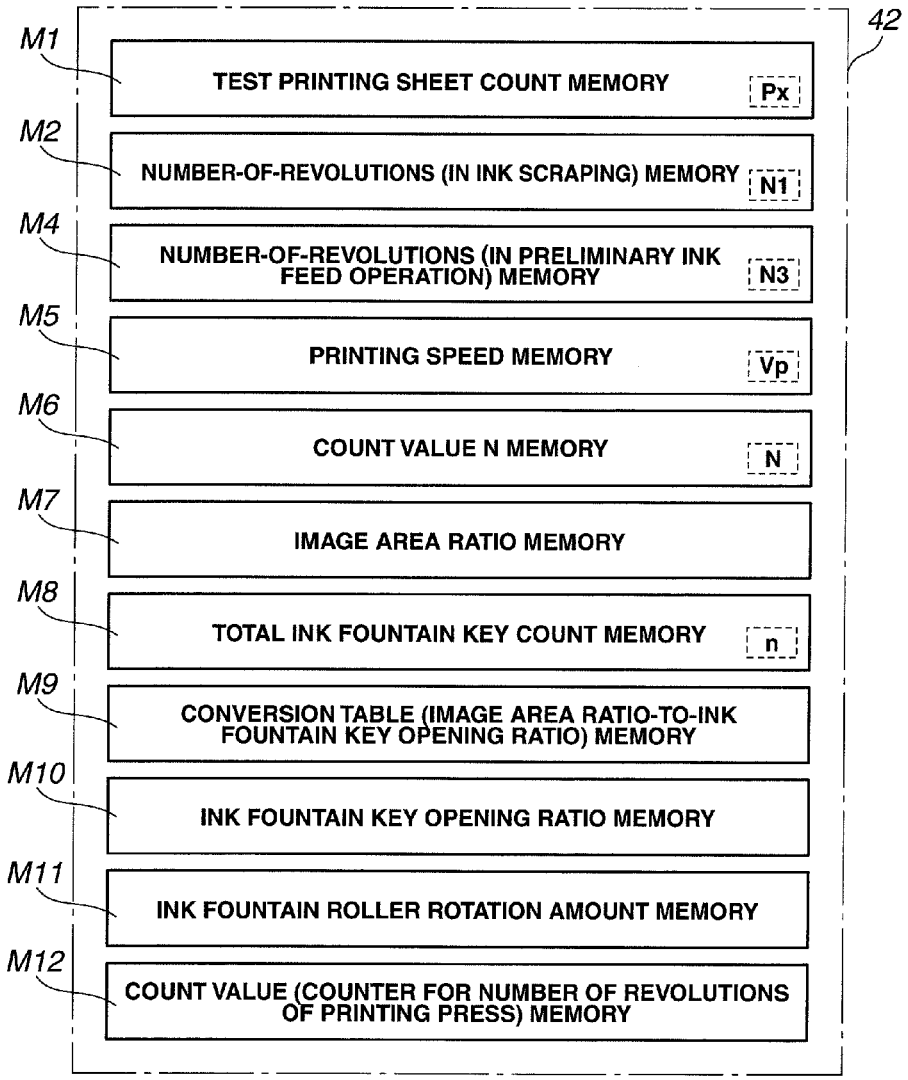
FIGS. 5A and 5B are views divisionally showing the contents of a memory in the ink supply amount control apparatus.
Figure 5B:
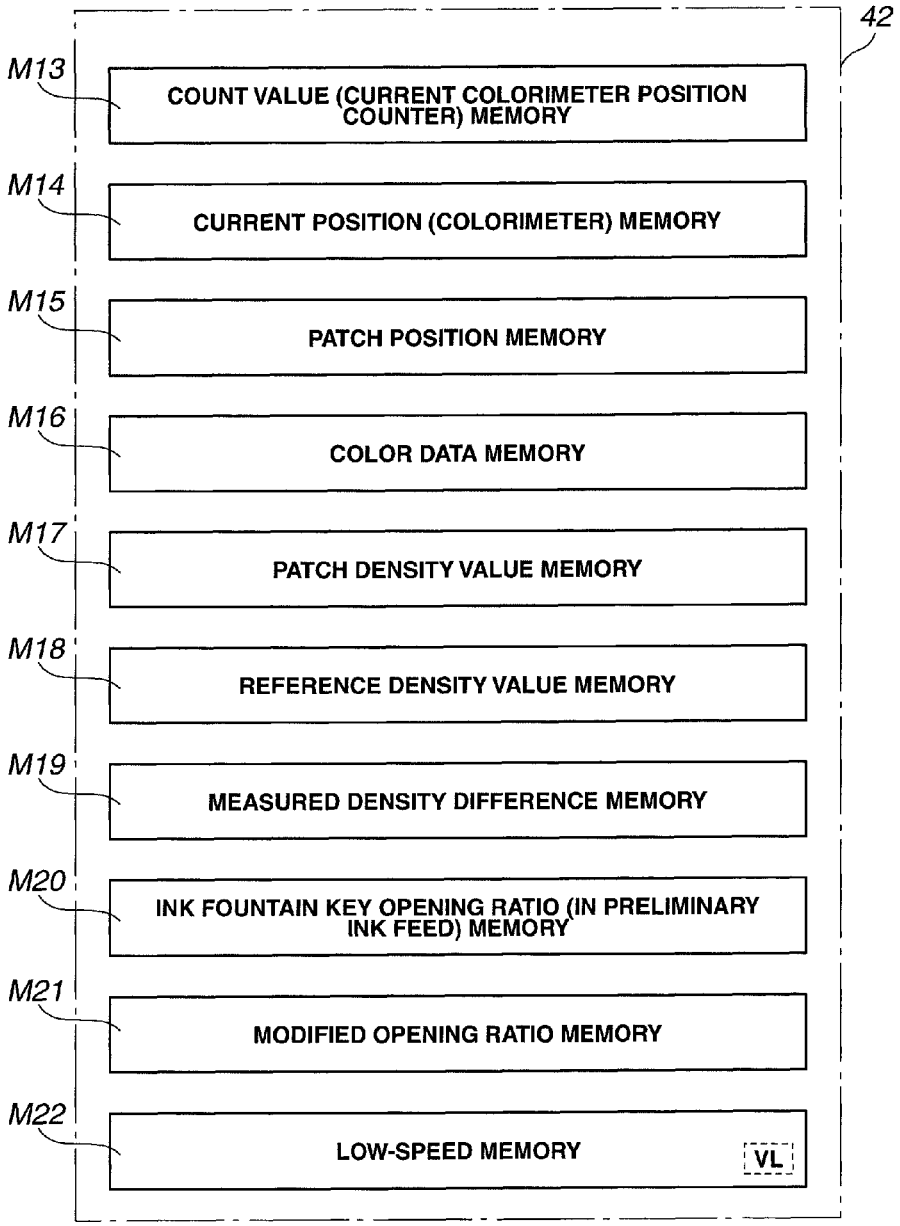

FIGS. 5A and 5B divisionally show the contents of the memory unit 42. The memory unit 42 includes memories M1, M2 and M4 to M22. The test printing sheet count memory M1 stores a test printing sheet count Px. The number-of-revolutions memory M2 stores the number N1 of revolutions of the printing press in ink scraping. The number-of-revolutions memory M4 stores the number N3 of revolutions of the printing press in the preliminary ink feed operation. The printing speed memory M5 stores a printing speed Vp. The count value memory M6 stores a count value N. The image area ratio memory M7 stores the image area ratio of a range corresponding to each ink fountain key.

The total ink fountain key count memory M8 stores a total ink fountain key count n. The conversion table memory M9 stores an image area ratio-to-ink fountain key opening ratio conversion table representing the relationship between the image area ratio and the opening ratio of the ink fountain key. The ink fountain key opening ratio memory M10 stores the opening ratio of each ink fountain key. The ink fountain roller rotation amount memory M11 stores the rotation amount of the ink fountain roller. The count value memory M12 stores the count value of the counter for counting the number of revolutions of the printing press.

The count value memory M13 stores the count value of the current colorimeter position detection counter. The current position memory M14 stores the current position of the colorimeter. The patch position memory M15 stores the position of each patch of a test printing sample to be measured by the colorimeter. The color data memory M16 stores color data from the colorimeter. The patch density value memory M17 stores the density value of each patch of the test printing sample. The reference density value memory M18 stores a reference density value. The measured density difference memory M19 stores the difference (measured density difference) between the density value of each patch of the test printing sample and the reference density value. The ink fountain key opening ratio memory M20 stores the opening ratio of each ink fountain key in preliminary ink feed. The modified opening ratio memory M21 stores the modified opening ratio (opening ratio in printing after preliminary ink feed) of each ink fountain key. The low-speed memory M22 stores a low speed VL of the printing press.

Figure 6:
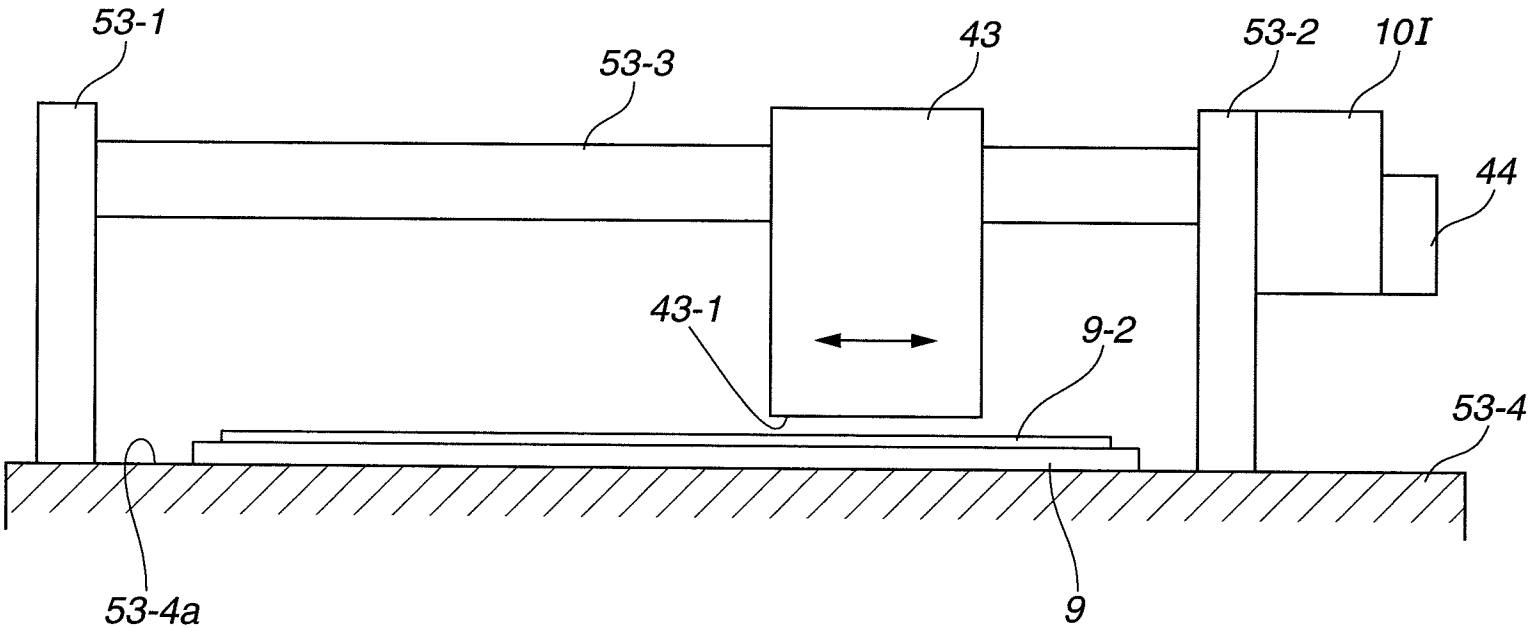
FIG. 6 is a side view showing the installation state of a colorimeter.

As shown in FIG. 6, the colorimeter 43 is attached to a ball screw (feed screw) 53-3 interposed between columns 53-1 and 53-2. The colorimeter moving motor 44 rotates the ball screw 53-3 forward or reversely. While the colorimeter 43 is guided by the ball screw 53-3 along with forward/reverse rotation of the ball screw 53-3, it moves between the columns 53-1 and 53-2. A head 43-1 of the colorimeter 43 faces a surface 53-4*a* of a measurement table 53-4 on which a measurement target is placed.

In FIG. 1, an ink fountain roller control apparatus 200 drives the ink fountain roller 3 in the ink supply apparatus. Ink fountain key control apparatuses 300-1 to 300-*n* control the opening ratios of the ink fountain keys 4-1 to 4-*n* in the ink supply apparatus. The ink fountain roller control apparatus 200 and ink fountain key control apparatuses 300-1 to 300-*n* are arranged for ink supply apparatuses of respective colors. However, the embodiment will explain one ink supply apparatus for descriptive convenience. That is, the operation of one of the ink supply apparatuses will be explained as a representative.

[Schematic Operation of Ink Supply Amount Control Apparatus]

Before a description of the detailed operation of the ink supply amount control apparatus 100, a schematic operation will be explained as steps (1) to (11) below to facilitate understanding.

(1) Test printing starts.

Figures 7A, 7B, 7C, 7D, 7E:
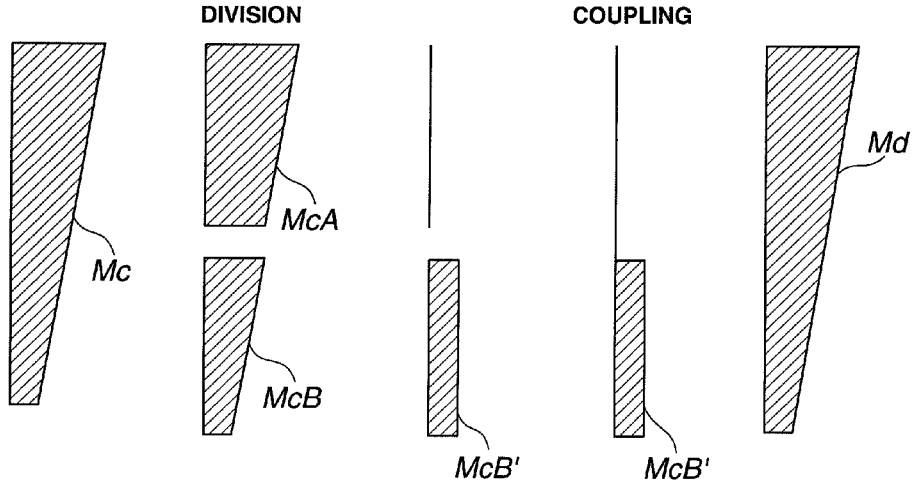
FIGS. 7A to 7G are views showing correction processes for the ink film thickness distribution of the ink roller group during test printing by using the ink supply amount control apparatus.

(2) After test printing by a predetermined number of sheets, sheet feed stops. Then, the ink form rollers 6-1 to 6-4 are thrown off, and printing (test printing) using the printing plate 7 is stopped. In this case, an ink film thickness distribution Mc corresponding to an image on the printing plate 7 remains in the ink roller group 6, as shown in FIG. 7A. That is, the ink film thickness distribution Mc during test printing remains.

(3) The density values of density measurement patches printed in ranges corresponding to the ink fountain keys 4-1 to 4-*n* on a printing product (test printing sample) printed by test printing are measured.

(4) The opening ratios of the ink fountain keys 4-1 to 4-*n* in preliminary ink feed and modified opening ratios (opening ratios in printing after preliminary ink feed) are obtained from differences between the measured density values of the density value measurement patches and reference density values, and the image area ratios of the ranges corresponding to the ink fountain keys 4-1 to **4-*n***.

(5) The opening ratios in preliminary ink feed that have been obtained in step (4) are set as the opening ratios of the ink fountain keys 4-1 to **4-*n***.

(6) The ink feed operation of the ink ductor roller 5 is stopped while the printing press stops. The ink roller group 6 is divided into the upstream roller subgroup 6A and downstream roller subgroup 6B. As shown in FIG. 7B, the ink film thickness distribution Mc of the ink roller group 6 is divided into an ink film thickness distribution McA of the upstream roller subgroup 6A and an ink film thickness distribution McB of the downstream roller subgroup 6B.

(7) The rotational speed of the printing press is increased to the printing speed, and the ink scraping blade 30 is thrown on the roller 6A2 in the upstream roller subgroup 6A. In this state, the printing press rotates by a predetermined number of revolutions (number N1 of revolutions in ink scraping), and ink in the upstream roller subgroup 6A is scraped. Hence, the ink film thickness distribution McA of the upstream roller subgroup 6A becomes almost 0, as shown in FIG. 7C. At this time, the ink film thickness distribution of the downstream roller subgroup 6B is leveled by the number N1 of revolutions in ink scraping, obtaining a flat ink film thickness distribution McB'.

(8) The upstream roller subgroup 6A and downstream roller subgroup 6B are coupled and returned to the single ink roller group 6 (FIG. 7D).

(9) It is confirmed that setting of the opening ratios in preliminary ink feed as the opening ratios of the ink fountain keys 4-1 to **4-*n* has been completed. Thereafter, the ink feed operation of the ink ductor roller 5 starts. The printing press rotates by a predetermined number of revolutions (number N3 of revolutions in the preliminary ink feed operation), forming an ink film thickness distribution Md in preliminary ink feed in the ink roller group 6 (FIG. 7**E).

Figures 7F, 7G:
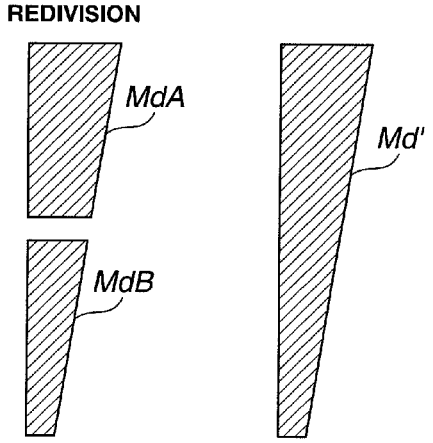

(10) The modified opening ratios (opening ratios in printing after preliminary ink feed) obtained in step (4) are set as the opening ratios of the ink fountain keys 4-1 to **4-*n*. In this case, the ink supply amount control apparatus 100 stands by while the printing press rotates at a low speed until the opening ratios of the ink fountain keys 4-1 to 4-*n* reach the opening ratios in printing after preliminary ink feed. At this time, the ink roller group 6 is divided again into the upstream roller subgroup 6A and downstream roller subgroup 6B so that the ink film thickness formed by preliminary ink feed does not become flat (FIG. 7F). After the opening ratios of the ink fountain keys 4-1 to 4-*n* reach the opening ratios in printing after preliminary ink feed, the upstream roller subgroup 6A and downstream roller subgroup 6B are coupled again and returned to the single ink roller group 6**.

While the opening ratios of the ink fountain keys 4-1 to **4-*n* reach the opening ratios in printing after preliminary ink feed, the ink roller group 6 idles to flatten the ink film thickness. However, the ink roller group 6 has been divided into the upstream roller subgroup 6A and downstream roller subgroup 6B. Thus, the ink film thicknesses become flat in the upstream roller subgroup 6A having a large ink film thickness and the downstream roller subgroup 6B having a small ink film thickness, respectively. By coupling the roller subgroups 6A and 6**B, the state in which the ink film thickness is large in the upstream roller subgroup and small in the downstream roller subgroup is maintained. After coupling, when ink is supplied in the same way as that in printing, it flows relatively quickly from the upstream side to the downstream side, quickly achieving a desired ink film thickness distribution. Note that this redivision & recoupling step can be omitted if the opening ratios in printing after preliminary ink feed can be set within a short time.

(11) The ink form rollers 6-1 and 6-4 are thrown on, sheet feed starts, and printing (test reprinting) starts.

For this reason, the ink film thickness distribution is modified quickly by preliminary ink feed. After that, the opening ratios are returned to those in printing after preliminary ink feed, and a corrected ink film thickness distribution Md' (FIG. 7G) is quickly formed in the ink roller group 6 during printing (during test reprinting). A proper printing product can therefore be printed quickly.

[Detailed Operation of Ink Supply Amount Control Apparatus]

[Data Input]

At the start of test printing, the operator inputs the test printing sheet count Px (FIG. 9A: step S101). In addition, the operator inputs the number N1 of revolutions in ink scraping, the number N3 of revolutions in the preliminary ink feed operation, and the printing speed Vp (steps S103, S105, and S107).

In this case, the test printing sheet count Px is input from the sheet count setting unit 37. The number N1 of revolutions in ink scraping is input from the number-of-revolutions setting unit 38 in ink scraping. The number N3 of revolutions in the preliminary ink feed operation is input from the number-of-revolutions setting unit 40 in the preliminary ink feed operation. The printing speed Vp is input from the printing speed setting unit 41.

The CPU 10 stores, in the memory M1, the test printing sheet count Px which has been input from the sheet count setting unit 37 (step S102). The CPU 10 stores, in the memory M2, the number N1 of revolutions in ink scraping which has been input from the number-of-revolutions setting unit 38 (step S104). The CPU 10 stores, in the memory M4, the number N3 of revolutions in the preliminary ink feed operation which has been input from the number-of-revolutions setting unit 40 (step S106). The CPU 10 stores, in the memory M5, the printing speed Vp which has been input from the printing speed setting unit 41 (step S108).

The CPU 10 stores, in the memory M7, the image area ratios of ranges corresponding to the ink fountain keys 4-1 to **4-*n* on the printing plate 7 that have been input from the input device 13. In the embodiment, the image area ratios of the ranges corresponding to the ink fountain keys 4-1 to 4-*n* on the printing plate 7 are measured using an "image area ratio measurement apparatus" as disclosed in Japanese Patent Laid-Open No. 58-201008 (literature 3) or Japanese Patent Laid-Open No. 58-201010 (literature 4). Image area ratios measured using the "image area ratio measurement apparatus" are written in a portable memory. The portable memory in which the image area ratios are written is set in the input device 13, inputting the image area ratios of the ranges corresponding to the ink fountain keys 4-1 to 4-*n* on the printing plate 7. Note that the CPU 10 and the "image area ratio measurement apparatus" may be connected online to directly receive, from the "image area ratio measurement apparatus", the image area ratios of the ranges corresponding to the ink fountain keys 4-1 to 4-*n* on the printing plate 7**.

Figure 8A:
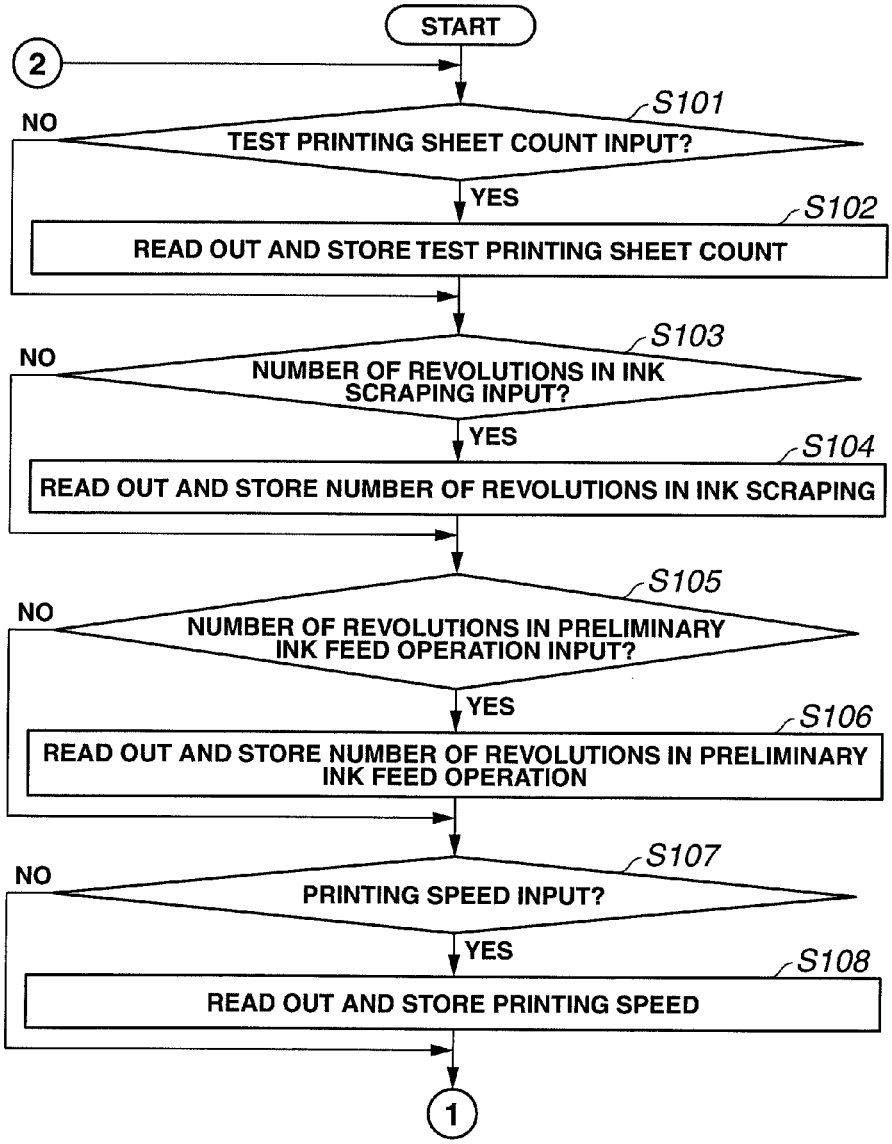
FIGS. 8A to 8R are flowcharts for explaining the detailed operation of the ink supply amount control apparatus.
Figure 8B:
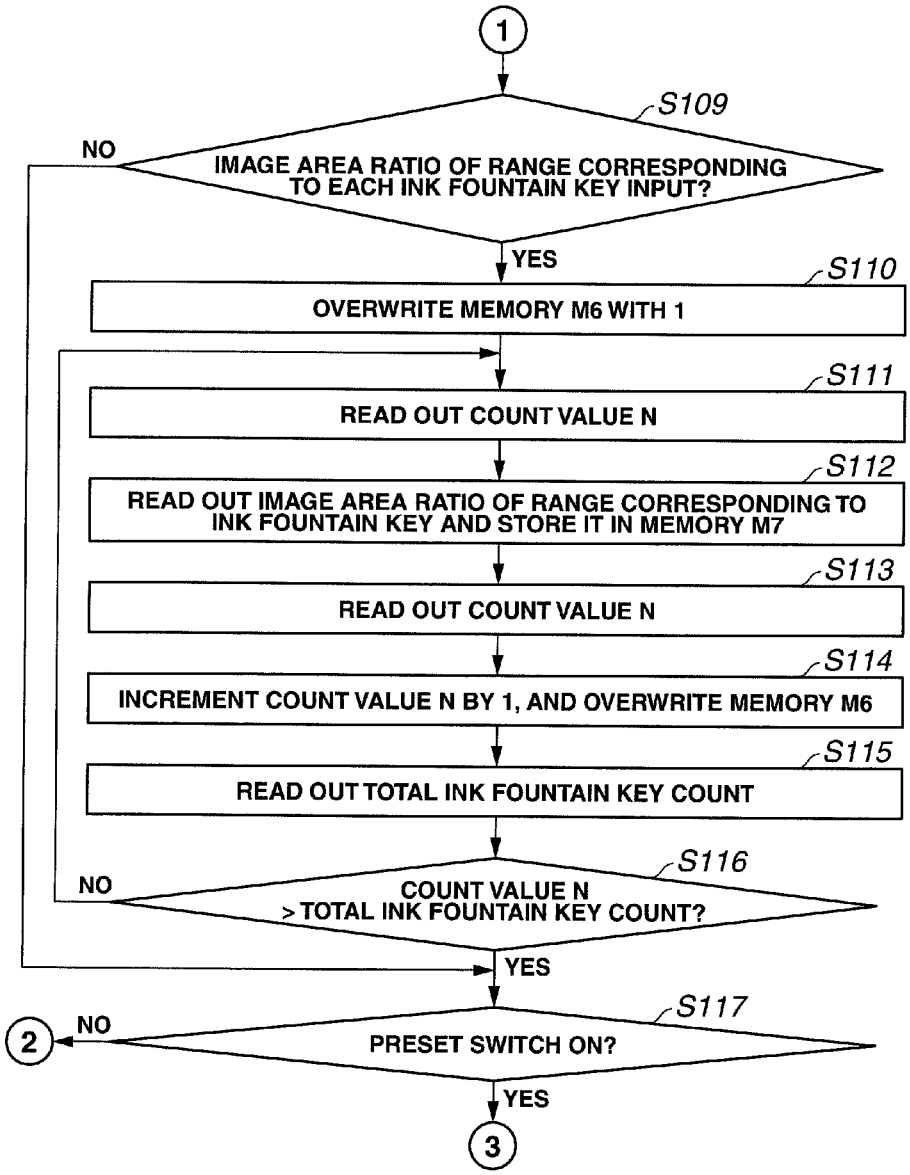

If the portable memory is set in the input device 13, that is, the image area ratios of the ranges corresponding to the ink fountain keys 4-1 to **4-*n* are input (FIG. 8B: YES in step S109), the CPU 10 overwrites the count value N in the memory M6 with N=1 (step S110), and reads out the count value N from the memory M6 (step S111). The CPU 10** reads out the image area ratio of a range corresponding to the Nth ink fountain key from the portable memory, and stores it at an address position for the Nth ink fountain key in the memory M7 (step S112).

The CPU 10 reads out the count value N from the memory M6 (step S113), increments the count value N by one, and overwrites the memory M6 with it (step S114). The CPU 10 reads out the total ink fountain key count n from the memory M8 (step S115). The CPU 10 repeats the processing operations in steps S111 to S116 until the count value N exceeds the total ink fountain key count n (YES in step S116). As a result, the image area ratios of the respective regions corresponding to the ink fountain keys 4-1 to 4-*n* on the printing plate 7 are read out from the portable memory, and stored in the memory M7.

[Setting of Opening Ratio of Ink Fountain Key]

Figure 8C:
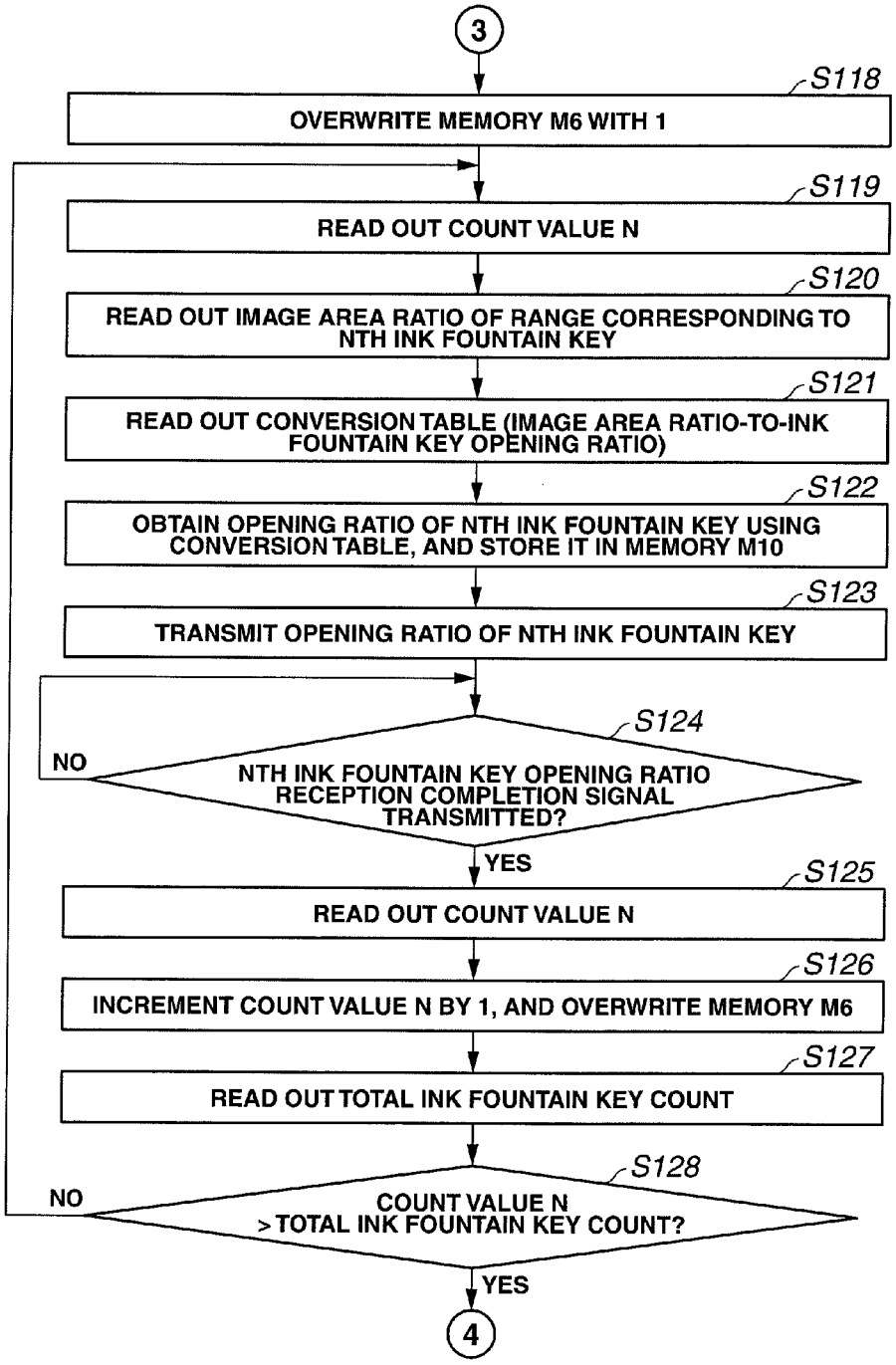

The operator turns on the preset start switch 16. If the preset switch 16 has been turned on (YES in step S117), the CPU 10 overwrites the count value N in the memory M6 with N=1 (FIG. 8C: step S118). The CPU 10 reads out the count value N from the memory M6 (step S119), and reads out the image area ratio of the range corresponding to the Nth ink fountain key from the address position for the Nth ink fountain key in the memory M7 (step S120).

The CPU 10 reads out the image area ratio-to-ink fountain key opening ratio conversion table from the memory M9 (step S121). By using the readout conversion table, the CPU 10 obtains the opening ratio of the Nth ink fountain key from the image area ratio of the range corresponding to the Nth ink fountain key. The CPU 10 stores the obtained opening ratio of the Nth ink fountain key at an address position for the Nth ink fountain key in the memory M10 (step S122), and transmits it to the Nth ink fountain key control apparatus 300 (step S123).

The CPU 10 confirms that the Nth ink fountain key control apparatus 300 has transmitted an Nth ink fountain key opening ratio reception completion signal (YES in step S124). Then, the CPU 10 reads out the count value N from the memory M6 (step S125), increments the count value N by one, and overwrites the memory M6 with it (step S126). The CPU 10 reads out the total ink fountain key count n from the memory M8 (step S127). The CPU 10 repeats the processing operations in steps S119 to S128 until the count value N exceeds the total ink fountain key count n (YES in step S128).

Accordingly, the opening ratios of the ink fountain keys 4-1 to 4-*n* that correspond to the image area ratios of the ranges corresponding to the ink fountain keys 4-1 to 4-*n* on the printing plate 7 are obtained, stored in the memory M10, and transmitted to the ink fountain key control apparatuses 300-1 to 300-*n*.

[Confirmation of Completion of Setting Opening Ratio of Ink Fountain Key]

Figure 8D:
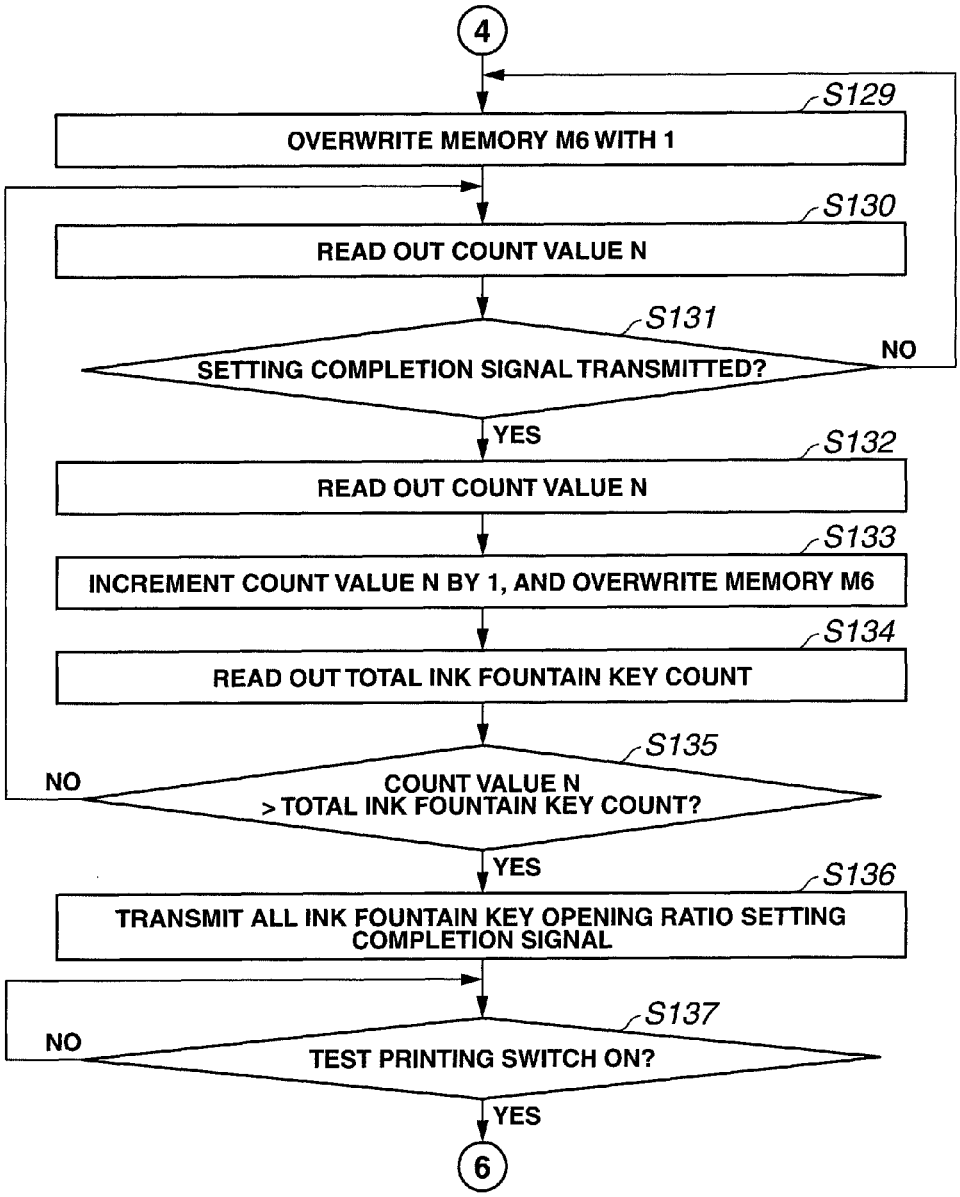
Figure 8E:
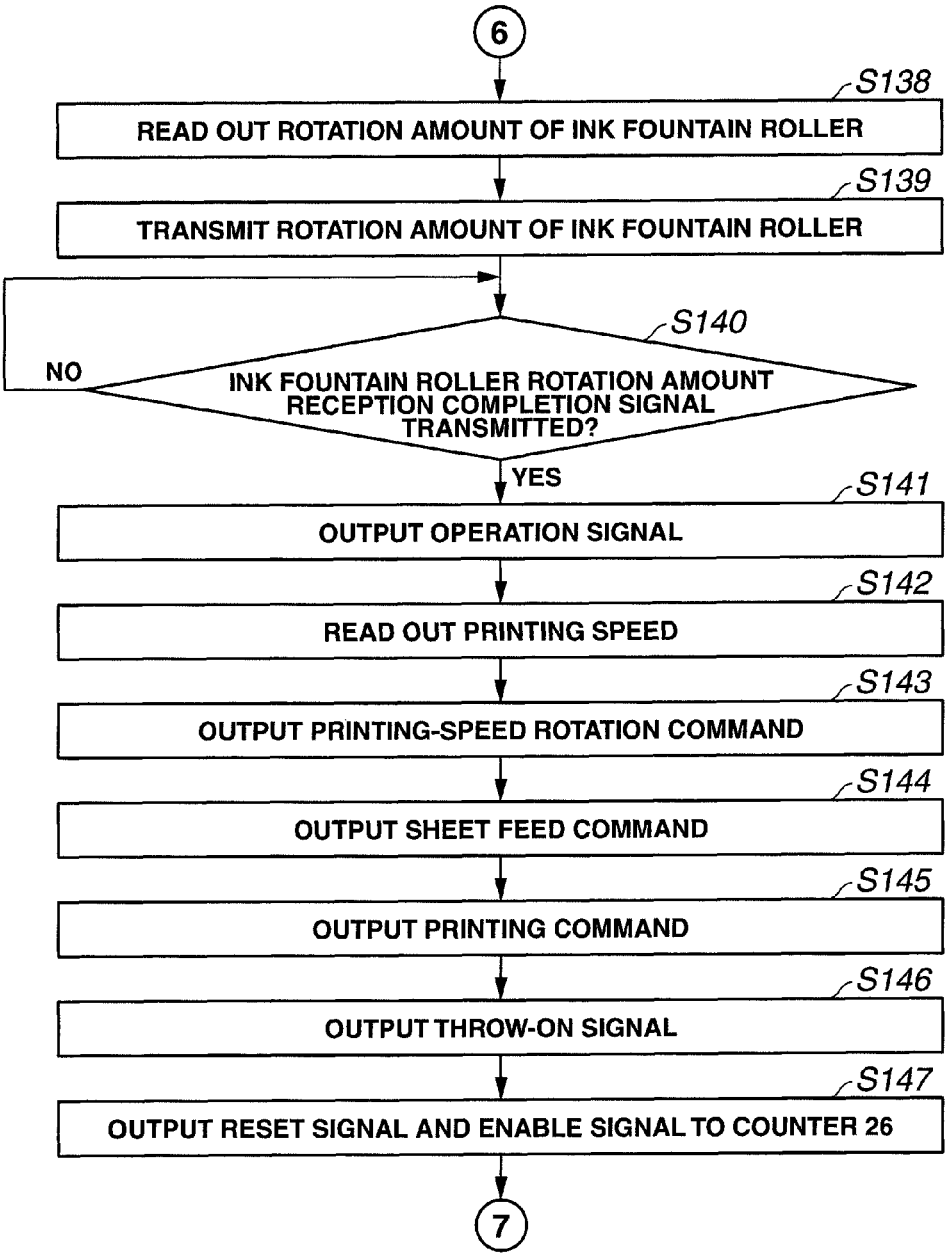

The CPU 10 overwrites the count value N in the memory M6 with N=1 (FIG. 8D: step S129), and reads out the count value N from the memory M6 (step S130). The CPU 10 confirms the presence/absence of an ink fountain key opening ratio setting completion signal from the Nth ink fountain key control apparatus 300 (step S131).

If the CPU 10 confirms that the Nth ink fountain key control apparatus 300 has transmitted the ink fountain key opening ratio setting completion signal (YES in step S131), it reads out the count value N from the memory M6 (step S132). The CPU 10 increments the count value N by one, and overwrites the memory M6 with it (step S133). The CPU 10 reads out the total ink fountain key count n from the memory M8 (step S134). The CPU 10 repeats the processing operations in steps S130 to S135 until the count value N exceeds the total ink fountain key count n (YES in step S135).

If the count value N exceeds the total ink fountain key count n (YES in step S135), the CPU 10 determines that the setting of the opening ratios of the ink fountain keys has been completed. The CPU 10 transmits an all ink fountain key opening ratio setting completion signal to all the ink fountain key control apparatuses 300 (300-1 to 300-*n*) (step S136).

[Test Printing]

The operator turns on the test printing switch 17. If the test printing switch 17 has been turned on (YES in step S137), the CPU 10 starts test printing processing.

Figure 8F:
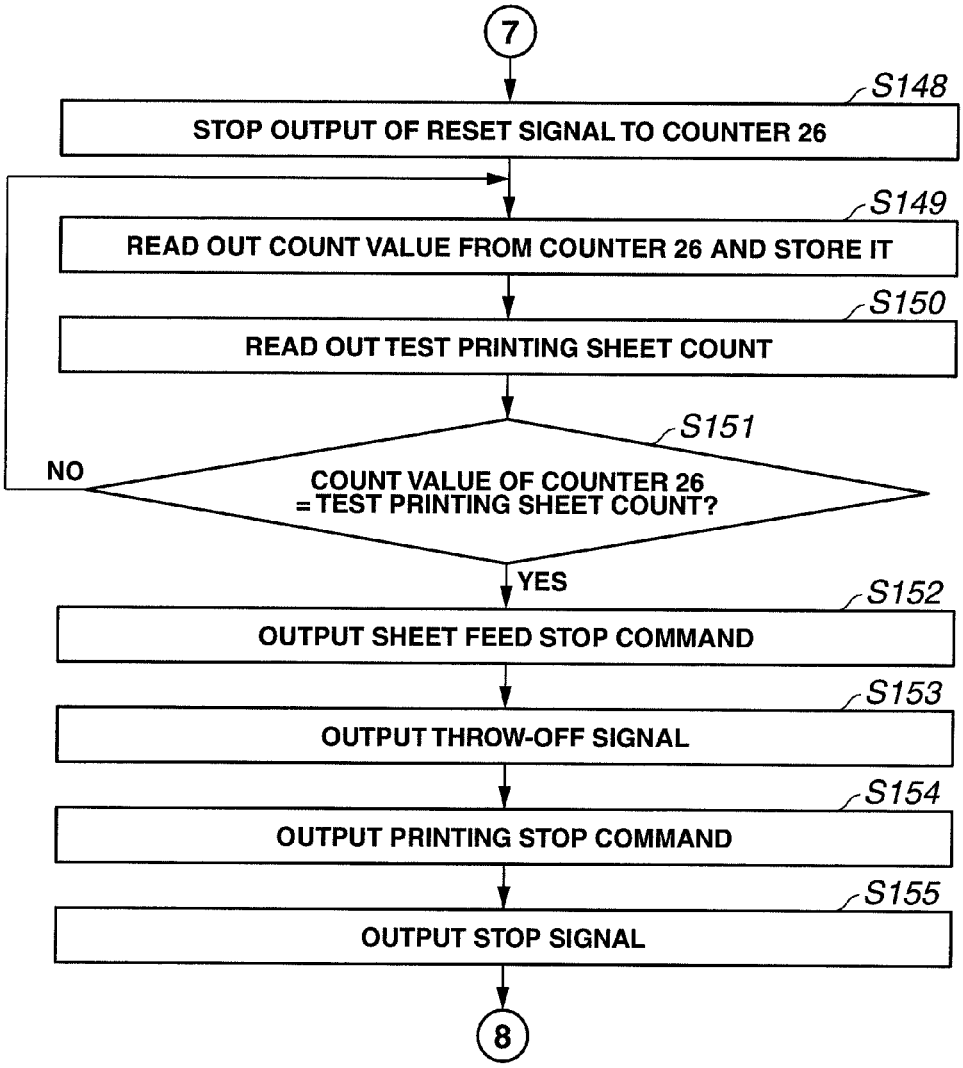

In the test printing processing, the CPU 10 reads out the rotation amount of the ink fountain roller that is stored in the memory M11 (FIG. 8F: step S138). The CPU 10 transmits the readout rotation amount of the ink fountain roller to the ink fountain roller control apparatus 200 (step S139). If the CPU 10 receives an ink fountain roller rotation amount reception completion signal from the ink fountain roller control apparatus 200 (YES in step S140), it outputs an operation signal to the ink ductor device 27 (step S141), and starts the ink feed operation of the ink ductor roller 5.

The CPU 10 reads out the printing speed Vp from the memory M5 (step S142), outputs a rotation command to the drive motor driver 22 via the D/A converter 24 (step S143), and sets the printing speed Vp as the speed of the printing press. The CPU 10 outputs a sheet feed command to the sheet feeder 33 (step S144) to start sheet feed to the printing press. The CPU 10 outputs a printing command to the printing unit 34 (step S145). Further, the CPU 10 outputs a throw-on signal to the valve 36 (step S146) to throw on the ink form rollers 6-1 to 6-4. The CPU 10 starts printing (test printing) using the printing plate 7.

The CPU 10 continues the test printing until the number of revolutions of the printing press reaches the test printing sheet count Px in the memory M1. More specifically, the CPU 10 outputs a throw-on signal to the valve 36 (step S146), and outputs a reset signal and enable signal to the counter 26 (step S147). The CPU 10 then stops the output of the reset signal to the counter 26 (FIG. 8F: step S148), and starts the count operation of the counter 26 from 0. The CPU 10 reads out the count value of the counter 26, and stores it in the memory M12 (step S149). The CPU 10 reads out the test printing sheet count Px from the memory M1 (step S150). The CPU 10 repeats the processing operations in steps S149 to S151 until the count value of the counter 26 reaches the test printing sheet count Px (YES in step S151).

If the count value of the counter 26 reaches the test printing sheet count Px (YES in step S151), the CPU 10 outputs a sheet feed stop command to the sheet feeder 33 to stop sheet feed (step S152). The CPU 10 outputs a throw-off signal to the valve 36 (step S153) to throw off the ink form rollers 6-1 to 6-4. The CPU 10 outputs a printing stop command to the printing unit 34 (step S154), and outputs a stop command to the motor driver 22 (step S155) to stop the printing press.

In this case, the ink film thickness distribution Mc corresponding to an image on the printing plate 7 remains in the ink roller group 6, as shown in FIG. 7A. That is, the ink film thickness distribution Mc during test printing remains.

[Density Measurement]

The operator extracts one of printing products after printing, and sets it as a test printing sample 9 on the measurement table 53-4 (FIG. 6). In this setting state, a color bar 9-2 of the test printing sample 9 is positioned below the head 43-1 of the colorimeter 43.

In this state, the operator turns on the density measurement switch 18. If the density measurement switch 18 has been turned on (FIG. 8G: YES in step S156), the CPU 10 starts density measurement processing. FIGS. 8H to 8J show the flowcharts of the density measurement processing.

[Color Data Sampling]

In the density measurement processing, the CPU 10 outputs a forward rotation signal to the motor driver 46 to rotate the motor 44 forward (step S157). Along with the forward rotation of the motor 44, the ball screw 53-3 rotates forward. The colorimeter 43 is guided by the ball screw 53-3, and moves from the home position in contact with the column 53-1 toward the column 53-2.

The CPU 10 overwrites the count value N in the memory M6 with N=1 (step S158). The CPU 10 reads out the count value of the counter 47, and stores it in the memory M13 (step S159). The CPU 10 calculates the current position of the colorimeter 43 from the readout count value, and stores it in the memory M14 (step S160). The CPU 10 reads out the count value N from the memory M6 (step S161), and reads out the Nth patch position of the test printing sample to be measured from the memory M15 (step S162). If the current position of the colorimeter 43 reaches the readout Nth patch position (YES in step S163), the CPU 10 outputs a measurement command signal to the colorimeter 43 (step S164). The colorimeter 43 samples, via the A/D converter 48, color data of the patch 9*a* of the test printing sample 9 that is positioned at the Nth patch position. The CPU 10 stores the sampled color data at an address position for the Nth ink fountain key in the memory M16 (FIG. 8I: steps S165 and S166).

The CPU 10 reads out the count value N from the memory M6 (step S167), increments the count value N by one, and overwrites the memory M6 with it (step S168). The CPU 10 reads out the total ink fountain key count n from the memory M8 (step S169). The CPU 10 repeats the processing operations in steps S159 to S170 until the count value N exceeds the total ink fountain key count n (YES in step S170). Every time the current position of the colorimeter 43 reaches the Nth patch position stored in the memory M15, the colorimeter 43 samples color data of the patch 9*a* of the test printing sample 9 that is positioned at the Nth patch position. The sampled color data is stored in the memory M16.

Upon completion of sampling color data from the test printing sample 9 (YES in step S170), the CPU 10 stops the forward rotation of the motor 44 (step S171). Then, the CPU 10 rotates the motor 44 reversely (step S172). If an output from the colorimeter home position detector 49 is enabled (YES in step S173) and the colorimeter 43 returns to the home position, the CPU 10 stops the reverse rotation of the motor 44 (step S174).

[Density Difference Calculation]

The CPU 10 overwrites the count value N in the memory M6 with N=1 (FIG. 8J: step S175), and reads out the count value N from the memory M6 (step S176). The CPU 10 reads out color data corresponding to the Nth ink fountain key from the address position for the Nth ink fountain key in the memory M16 (step S177). The CPU 10 calculates, from the readout color data, the density value of a patch corresponding to the Nth ink fountain key on the test printing sample 9, and stores it at an address position for the Nth ink fountain key in the memory M17 (step S178).

The CPU 10 reads out a reference density value from the memory M18 (step S179). The CPU 10 subtracts the reference density value from the density value of the patch corresponding to the Nth ink fountain key, and stores the subtraction result as the measured density difference of the patch corresponding to the Nth ink fountain key on the test printing sample 9 at an address position for the Nth ink fountain key in the memory M19 (step S180). The CPU 10 displays the measured density on the display unit 14 (step S181).

The CPU 10 reads out the count value N from the memory M6 (step S182), increments the count value N by one, and overwrites the memory M6 with it (step S183). The CPU 10 reads out the total ink fountain key count n from the memory M8 (step S184). The CPU 10 repeats the processing operations in steps S176 to S185 until the count value N exceeds the total ink fountain key count n (YES in step S185). Accordingly, the measured density differences of patches corresponding to the ink fountain keys 4-1 to 4-*n* on the test printing sample 9 are stored in the memory M19.

Note that the embodiment adopts a spectrometer as the colorimeter 43. An output value of each wavelength from the spectrometer is multiplied by the transmittance of each wavelength of a filter used to measure a solid patch of each color by a densitometer. The resultant output values are added, obtaining a density value of each color.

[Density Modification]

The operator turns on the density modification switch 19. If the density modification switch 19 has been turned on (FIG. 8G: YES in step S187), the CPU 10 starts density modification processing. FIGS. 8K to 8R show the flowcharts of the density modification processing.

[Calculation of Opening Ratio of Ink Fountain Key in Preliminary Ink Feed and Modified Opening Ratio (Opening Ratio in Printing after Preliminary Ink Feed)]

If the density modification switch 19 is turned on (YES in step S187), the CPU 10 overwrites the count value N in the memory M6 with N=1 (FIG. 8K: step S188), and reads out the count value N from the memory M6 (step S189). The CPU 10 reads out, as $\Delta D_N$ from the memory M19, the measured density difference of a patch corresponding to the Nth ink fountain key on the test printing sample 9 (step S190). The CPU 10 reads out, as $S_N$ from the memory M7, the image area ratio of a range corresponding to the Nth ink fountain key (step S191). The CPU 10 calculates the opening ratio $\theta_N'$ of the Nth ink fountain key in preliminary ink feed using equation (1):

$$\theta_N' = \alpha \cdot \Delta D_N \cdot S_N \cdot \beta \tag{1}$$

The CPU 10 stores the opening ratio $\theta_N'$ at an address position for the Nth ink fountain key in the memory M20 (step S192). Also, the CPU 10 calculates the modified opening ratio (opening ratio in printing after preliminary ink feed) $\theta_N''$ of the Nth ink fountain key using equation (2):

$$\theta_N'' = S_N - \alpha \cdot \Delta D_N \cdot S_N \tag{2}$$

The CPU 10 stores the modified opening ratio $\theta_N''$ at an address position for the Nth ink fountain key in the memory M21 (step S193).

In equations (1) and (2), $\alpha$ is a predetermined correction coefficient. In equation (1), $\beta$ is a correction coefficient obtained by dividing the current rotation amount of the ink fountain roller 3 by the reference rotation amount of the ink fountain roller 3.

[Setting to Opening Ratio of Ink Fountain Key in Preliminary Ink Feed]

The CPU 10 transmits the opening ratio $\theta_N'$ of the Nth ink fountain key in preliminary ink feed to the Nth ink fountain key control apparatus 300 (step S194). If the CPU 10 receives an Nth ink fountain key opening ratio reception completion signal from the Nth ink fountain key control apparatus 300 (YES in step S195), it reads out the count value N from the memory M6 (step S196). The CPU 10 increments the count value N by one, and overwrites the memory M6 with it (step S197). The CPU 10 reads out the total ink fountain key count n from the memory M8 (step S198). The CPU 10 repeats the processing operations in steps S189 to S199 until the count value N exceeds the total ink fountain key count n (YES in step S199).

As a result, the memory M20 stores the opening ratios θ1' to θn' of the ink fountain keys 4-1 to **4-*n* in preliminary ink feed. The memory M21 stores the modified opening ratios (opening ratios in printing after preliminary ink feed) θ1" to θn" of the ink fountain keys 4-1 to 4-*n*. The opening ratios θ1' to θn' in preliminary ink feed are transmitted to the ink fountain key control apparatuses 300-1 to 300-*n***.

[Division of Ink Roller Group]

The CPU 10 outputs an operation stop signal to the ink ductor device 27 (FIG. 8L: step S200) to stop the ink feed operation of the ink ductor roller 5. Note that the throw-off operation of the ink form rollers 6-1 to 6-4 by the CPU 10 (step S153), the stop of the ink feed operation of the ink ductor roller 5 (step S200), the ink ductor device 27, and the pneumatic cylinder 35 constitute a step/means for disconnecting the ink roller group 6 from the ink supply path. Thereafter, the CPU 10 outputs a division signal to the valve 29 (step S201) to divide the ink roller group 6 into the upstream roller subgroup 6A and downstream roller subgroup 6B (see FIG. 3).

As shown in FIG. 7B, the ink film thickness distribution Mc of the ink roller group 6 is divided into the ink film thickness distribution McA of the upstream roller subgroup 6A and the ink film thickness distribution McB of the downstream roller subgroup 6B.

[Scraping of Ink in Upstream Roller Subgroup]

Figure 4:
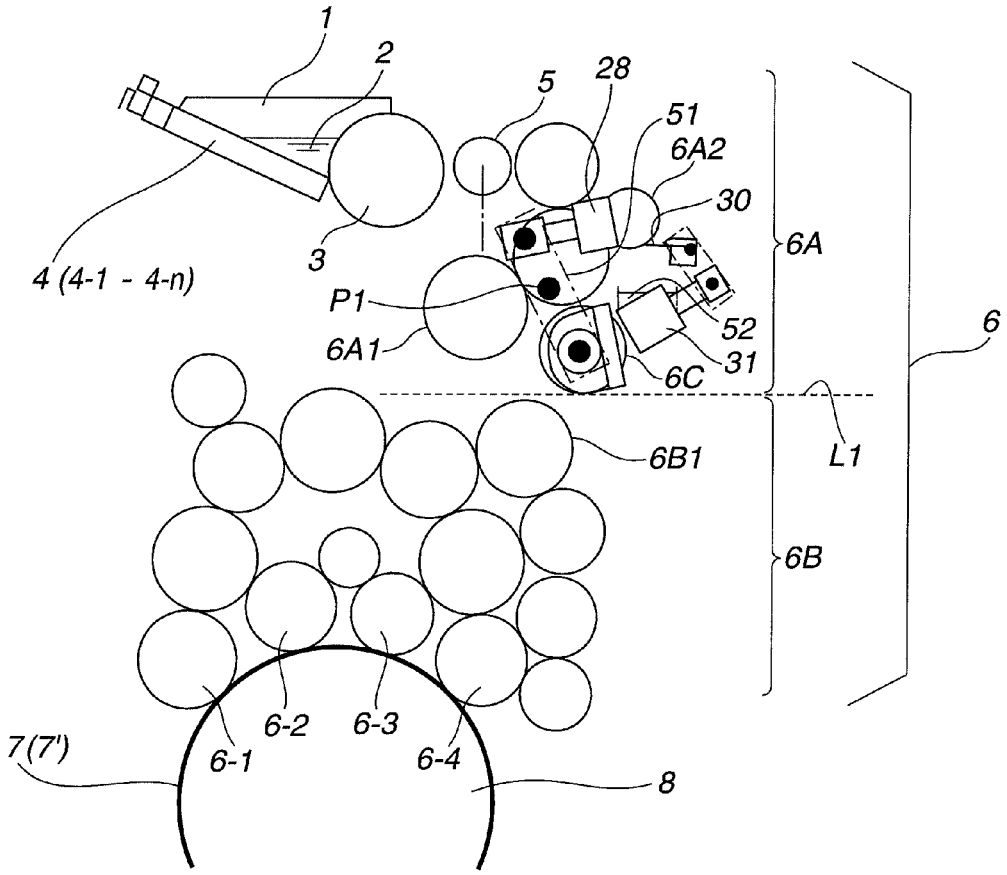
FIG. 4 is a view showing the main part (state in which the ink roller group is divided and ink in an upstream roller subgroup is scraped by a blade) of the ink supply apparatus in the printing unit to be controlled by the ink supply amount control apparatus.

The CPU 10 reads out the printing speed Vp from the memory M5 (step S202), and outputs a rotation command to the motor driver 22 via the D/A converter 24 (step S203). In response to this, the printing press starts rotating, and its speed rises up to the printing speed Vp. The CPU 10 outputs a throw-on signal to the valve 32 (step S204). As shown in FIG. 4, the pneumatic cylinder 31 contracts, and the ink scraping blade 30 comes into contact with the outer surface of the roller 6A2, starting scraping of ink (removal of ink) in the upstream roller subgroup 6A.

The CPU 10 keeps removing the ink in the upstream roller subgroup 6A until the number of revolutions of the printing press reaches the number N1 of revolutions in ink scraping in the memory M2. More specifically, the CPU 10 outputs a throw-on signal to the valve 32 (step S204), and outputs a reset signal and enable signal to the counter 26 (step S205). The CPU 10 then stops the output of the reset signal to the counter 26 (step S206), and starts the count operation of the counter 26 from 0. The CPU 10 reads out the count value of the counter 26, and stores it in the memory M12 (step S207). The CPU 10 reads out the number N1 of revolutions in ink scraping from the memory M2 (step S208). The CPU 10 repeats the processing operations in steps S207 to S209 until the count value of the counter 26 for counting the number of revolutions of the printing press reaches the number N1 of revolutions in ink scraping (YES in step S209).

If the count value of the counter 26 reaches the number N1 of revolutions in ink scraping (YES in step S209), the CPU 10 outputs a throw-off signal to the valve 32 (FIG. 8M: step S210), completing the removal of the ink in the upstream roller subgroup 6A.

As shown in FIG. 7C, the ink film thickness distribution McA of the upstream roller subgroup 6A becomes almost 0. At this time, the ink film thickness distribution of the downstream roller subgroup 6B is leveled by the number N1 of revolutions in ink scraping, obtaining the flat ink film thickness distribution McB'.

[Coupling of Ink Roller Group]

The CPU 10 outputs a coupling signal to the roller group division/coupling pneumatic cylinder valve 29 (step S211) to couple the upstream roller subgroup 6A and downstream roller subgroup 6B, as shown in FIG. 2, and return them to the single ink roller group 6 (FIG. 7D).

[Confirmation of Completion of Setting Opening Ratio of Ink Fountain Key]

The CPU 10 overwrites the count value N in the memory M6 with N=1 (step S212), and reads out the count value N from the memory M6 (step S213). The CPU 10 confirms the presence/absence of an ink fountain key opening ratio setting completion signal from the Nth ink fountain key control apparatus 300 (step S214).

If the CPU 10 confirms that the Nth ink fountain key control apparatus 300 has transmitted the ink fountain key opening ratio setting completion signal (YES in step S214), the CPU 10 reads out the count value N from the memory M6 (step S215). The CPU 10 increments the count value N by one, and overwrites the memory M6 with it (step S216). The CPU 10 reads out the total ink fountain key count n from the memory M8 (step S217). The CPU 10 repeats the processing operations in steps S213 to S218 until the count value N exceeds the total ink fountain key count n (YES in step S218).

If the count value N exceeds the total ink fountain key count n (YES in step S218), the CPU 10 determines that the setting of the opening ratios of the ink fountain keys has been completed. The CPU 10 transmits an all ink fountain key opening ratio setting completion signal to all the ink fountain key control apparatuses 300 (300-1 to **300-*n*) (step S219**).

[Preliminary Ink Feed]

After transmitting the all ink fountain key opening ratio setting completion signal to all the ink fountain key control apparatuses 300 (step S219), the CPU 10 reads out the rotation amount of the ink fountain roller that is stored in the memory M11 (step S220). The CPU 10 transmits the readout rotation amount of the ink fountain roller to the ink fountain roller control apparatus 200 (FIG. 8N: step S221). If the CPU 10 receives an ink fountain roller rotation amount reception completion signal from the ink fountain roller control apparatus 200 (YES in step S222), it outputs an operation signal to the ink ductor device 27 (step S223), and starts the ink feed operation of the ink ductor roller 5. The CPU 10 continues the ink feed operation of the ink ductor roller 5 until the number of revolutions of the printing press reaches the number N3 of revolutions in the preliminary ink feed operation in the memory M4 (steps S224 to S228).

More specifically, the CPU 10 outputs a reset signal and enable signal to the counter 26 for counting the number of revolutions of the printing press (step S224). The CPU 10 stops the output of the reset signal to the counter 26 for counting the number of revolutions of the printing press (step S225), and starts, from 0, the count operation of the counter 26 for counting the number of revolutions of the printing press. The CPU 10 reads out the count value of the counter 26 for counting the number of revolutions of the printing press, and stores it in the memory M12 (step S226). The CPU 10 reads out the number N3 of revolutions in the preliminary ink feed operation from the memory M4 (step S227). The CPU 10 repeats the processing operations in steps S226 to S228 until the count value of the counter 26 for counting the number of revolutions of the printing press reaches the number N3 of revolutions in the preliminary ink feed operation (YES in step S228).

As a result, the ink film thickness distribution Md in preliminary ink feed is formed in the single returned ink roller group 6 (FIG. 7E).

In the preliminary ink feed, the ink supply amount changes slightly at a portion having a low image area ratio (low opening ratio of the ink fountain key) even with the same density difference, and greatly at a portion having a high image area ratio (high opening ratio of the ink fountain key) even with the same density difference in accordance with equation (1) described above. The ink supply amount can be set to an appropriate value regardless of the image area ratio of a range corresponding to each ink fountain key, and the ink film thickness distribution can be modified quickly.

In the embodiment, the opening ratio $\theta_N'$ (N=1 to n) of the ink fountain key in preliminary ink feed is calculated using the correction coefficient β based on the rotation amount of the ink fountain key, as represented by equation (1). The opening ratio $\theta_N'$ (N=1 to n) of the ink fountain key in preliminary ink feed can be made more accurate, and the ink film thickness distribution can be modified more quickly.

Although the correction coefficient β based on the rotation amount of the ink fountain key is used to calculate the opening ratio $\theta_N'$ of the ink fountain key in preliminary ink feed in the embodiment, it may not always be used.

[Redivision of Ink Roller Group]

If the count value of the counter 26 reaches the number N3 of revolutions in the preliminary ink feed operation (YES in step S228), the CPU 10 outputs an operation stop signal to the ink ductor device 27 (step S228-1) to stop the ink feed operation of the ink ductor roller 5. Then, the CPU 10 outputs a division signal to the valve 29 (step S229) to divide the ink roller group 6 into the upstream roller subgroup 6A and downstream roller subgroup 6B (see FIG. 7F). The CPU 10 reads out the low speed VL from the memory M22 (step S230), and outputs a rotation command to the motor driver 22 (step S231). In response to this, the ink feed operation of the ink ductor roller 5 is stopped, and the printing press rotates at the low speed VL while the ink roller group 6 is divided into the upstream roller subgroup 6A and downstream roller subgroup 6B.

[Setting to Modified Opening Ratio (Opening Ratio in Printing after Preliminary Ink Feed) of Ink Fountain Key]

During rotation at the low speed VL, the CPU 10 overwrites the count value N in the memory M6 with N=1 (FIG. 8O: step S232), and reads out the count value N from the memory M6 (step S233). The CPU 10 reads out the modified opening ratio $\theta_N''$ of the Nth ink fountain key from the memory M21 (step S234), and transmits it to the Nth ink fountain key control apparatus 300 (step S235).

If the CPU 10 receives an Nth ink fountain key opening ratio reception completion signal from the Nth ink fountain key control apparatus 300 (YES in step S236), it reads out the count value N from the memory M6 (step S237). The CPU 10 increments the count value N by one, and overwrites the memory M6 with it (step S238). The CPU 10 reads out the total ink fountain key count n from the memory M8 (step S239). The CPU 10 repeats the processing operations in steps S233 to S240 until the count value N exceeds the total ink fountain key count n (YES in step S240). The modified opening ratios θ1" to θn" are then transmitted to the ink fountain key control apparatuses 300-1 to **300-*n***.

[Confirmation of Completion of Setting Opening Ratio of Ink Fountain Key]

The CPU 10 overwrites the count value N in the memory M6 with N=1 (FIG. 8P: step S241), and reads out the count value N from the memory M6 (step S242). The CPU 10 confirms the presence/absence of an ink fountain key opening ratio setting completion signal from the Nth ink fountain key control apparatus 300 (step S243).

If the CPU 10 confirms that the Nth ink fountain key control apparatus 300 has transmitted the ink fountain key opening ratio setting completion signal (YES in step S243), it reads out the count value N from the memory M6 (step S244). The CPU 10 increments the count value N by one, and overwrites the memory M6 with it (step S245). The CPU 10 reads out the total ink fountain key count n from the memory M8 (step S246). The CPU 10 repeats the processing operations in steps S242 to S247 until the count value N exceeds the total ink fountain key count n (YES in step S247).

If the count value N exceeds the total ink fountain key count n (YES in step S247), the CPU 10 determines that the setting of the opening ratios of the ink fountain keys has been completed. The CPU 10 transmits an all ink fountain key opening ratio setting completion signal to all the ink fountain key control apparatuses 300 (300-1 to **300-*n*) (step S248**).

[Recoupling of Ink Roller Group]

After transmitting the all ink fountain key opening ratio setting completion signal to all the ink fountain key control apparatuses 300 (step S248), the CPU 10 outputs a coupling signal to the roller group division/coupling pneumatic cylinder valve 29 (FIG. 8Q: step S249) to couple again the upstream roller subgroup 6A and downstream roller subgroup 6B and return them to the single ink roller group 6.

[Test Reprinting]

The CPU 10 reads out the rotation amount of the ink fountain roller that is stored in the memory M11 (step S250). The CPU 10 transmits the readout rotation amount of the ink fountain roller to the ink fountain roller control apparatus 200 (step S251). If the CPU 10 receives an ink fountain roller rotation amount reception completion signal from the ink fountain roller control apparatus 200 (YES in step S252), it outputs an operation signal to the ink ductor device 27 (step S253), and starts the ink feed operation of the ink ductor roller 5.

The CPU 10 reads out the printing speed Vp from the memory M5 (step S254). The CPU 10 outputs a rotation command to the motor driver 22 via the D/A converter 24 (step S255), and sets the printing speed Vp as the speed of the printing press. The CPU 10 outputs a sheet feed command to the sheet feeder 33 (step S256) to start sheet feed to the printing press. The CPU 10 outputs a printing command to the printing unit 34 (step S257). In addition, the CPU 10 outputs a throw-on signal to the valve 36 (step S258) to throw on the ink form rollers 6-1 to 6-4. The CPU 10 starts printing (test reprinting) using the printing plate 7.

In this manner, the ink film thickness distribution is modified quickly by preliminary ink feed, and an opening ratio in printing after preliminary ink feed is set again. Accordingly, the corrected ink film thickness distribution Md' (FIG. 7G) is quickly formed in the ink roller group 6 during printing (during test reprinting).

Figure 8G:
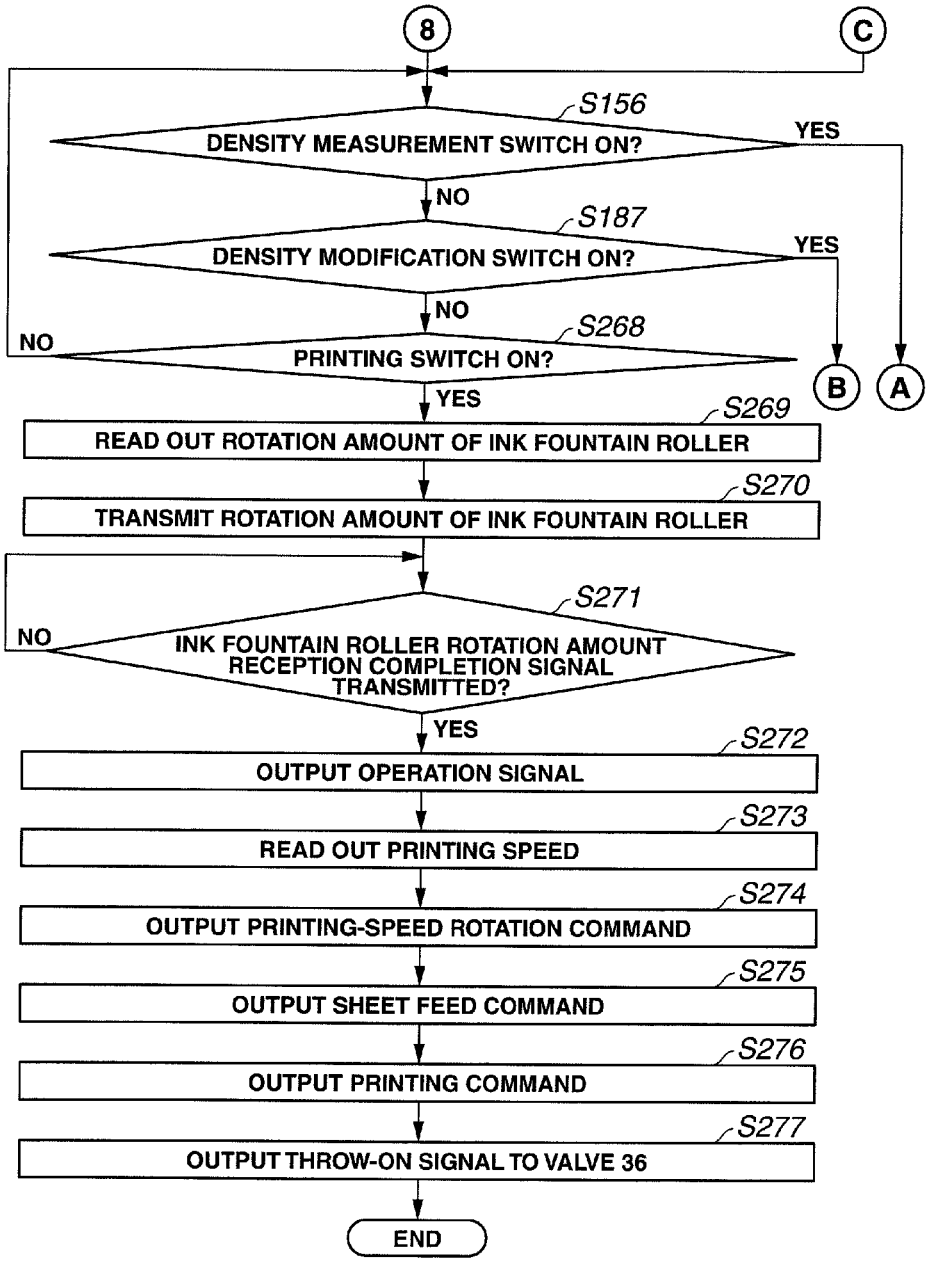
Figure 8H:
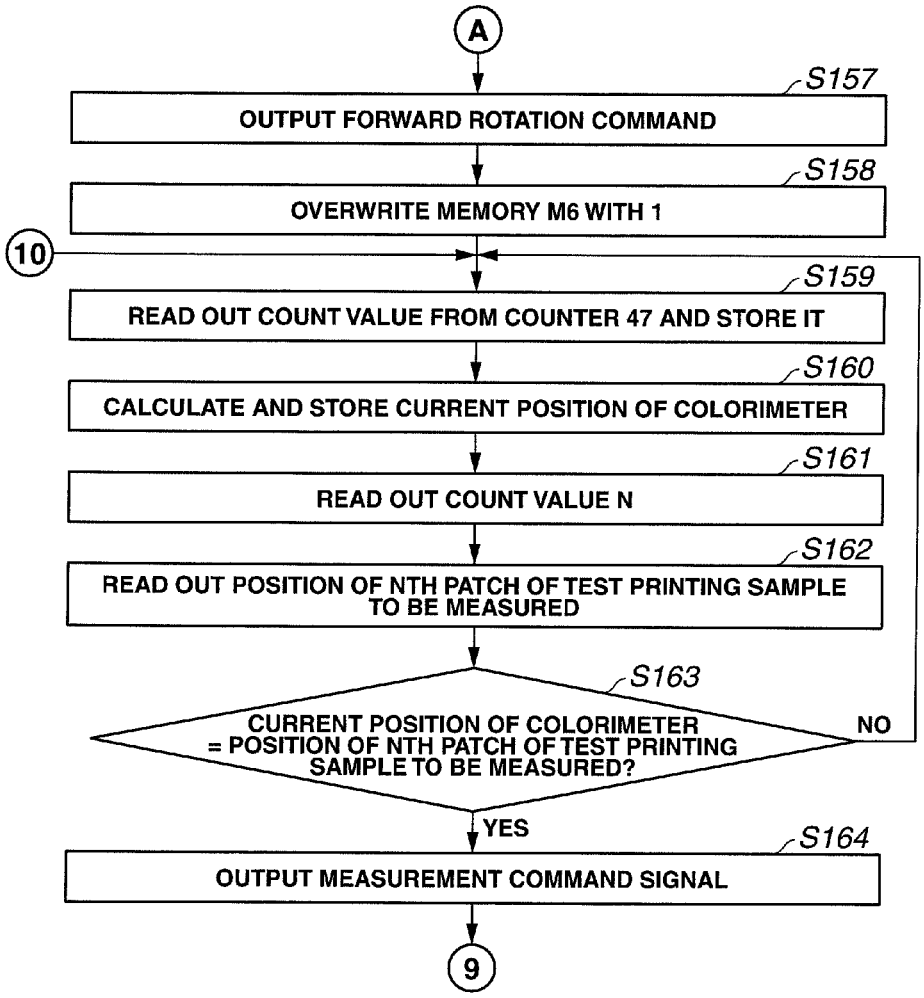
Figure 8I:
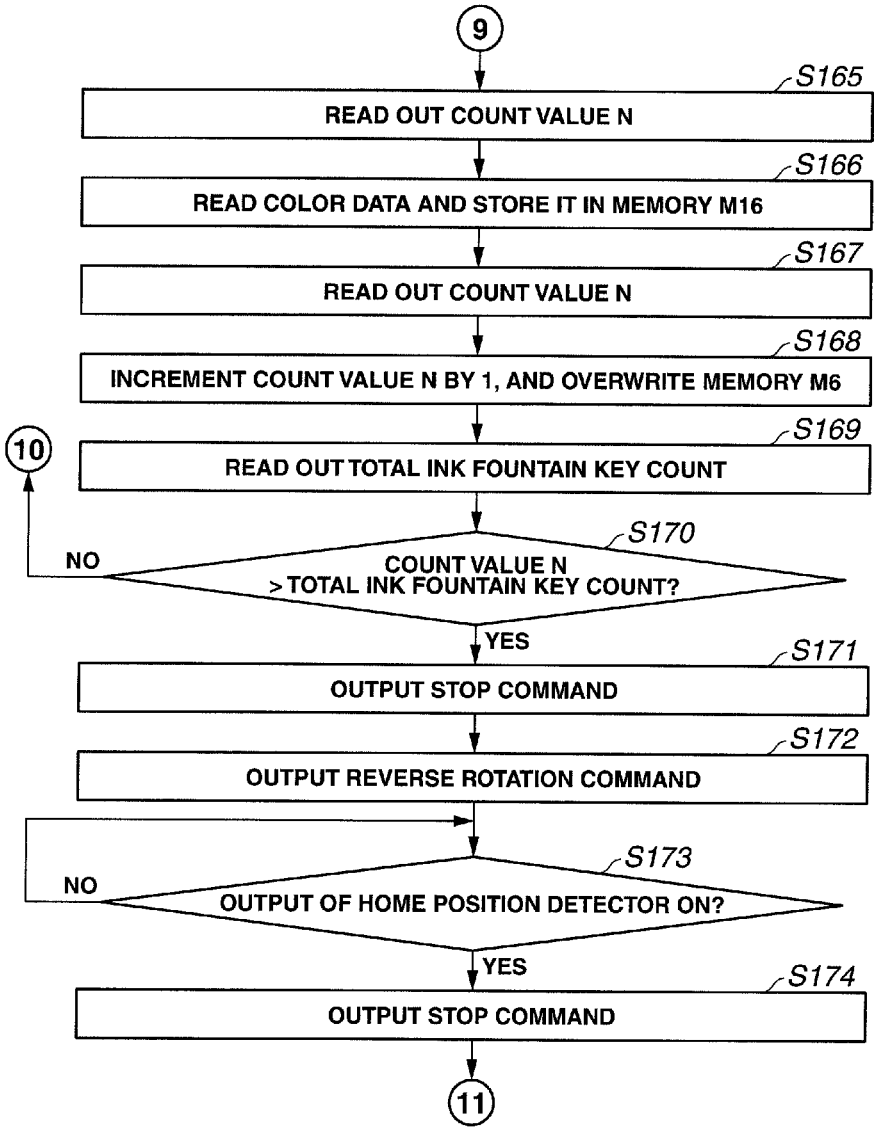
Figure 8J:
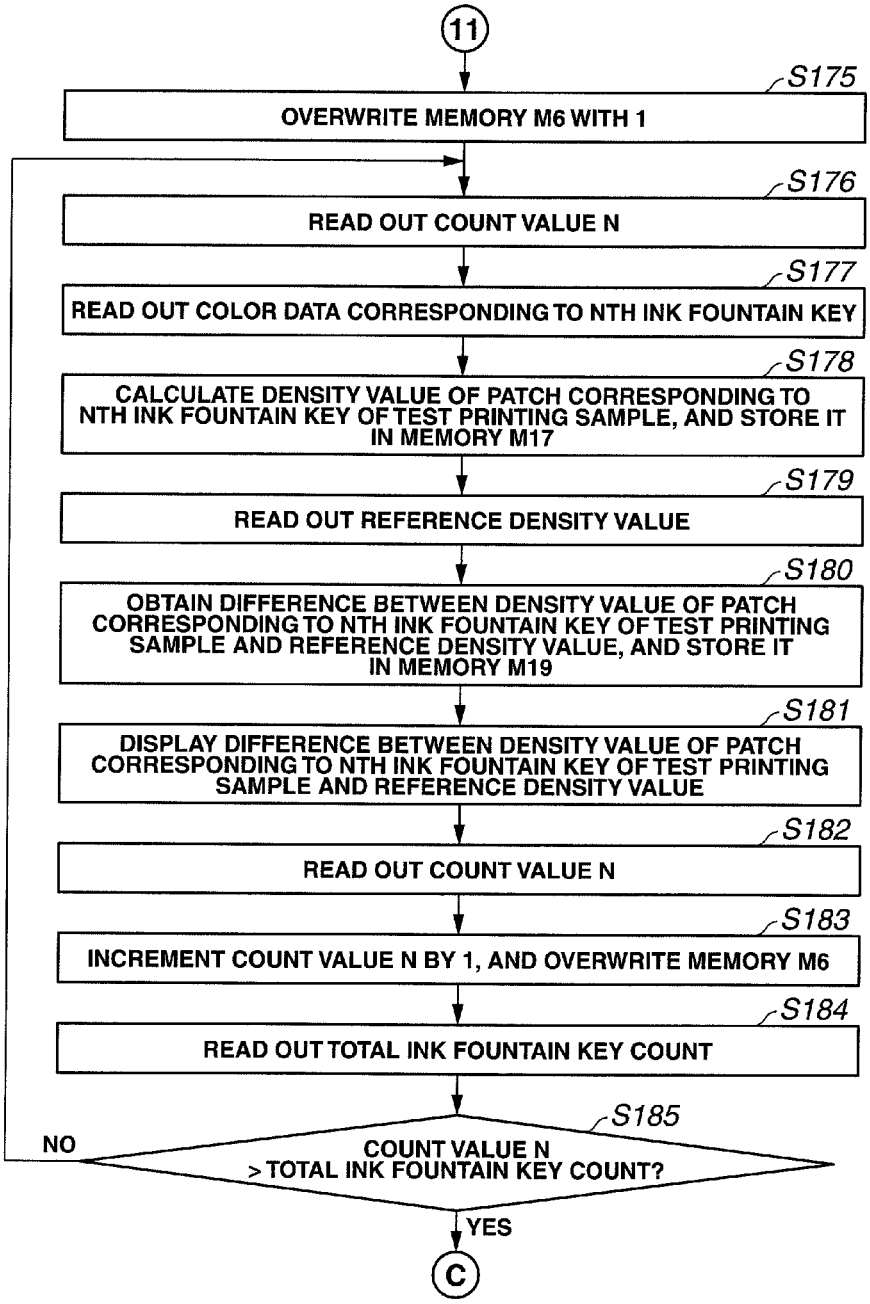
Figure 8K:
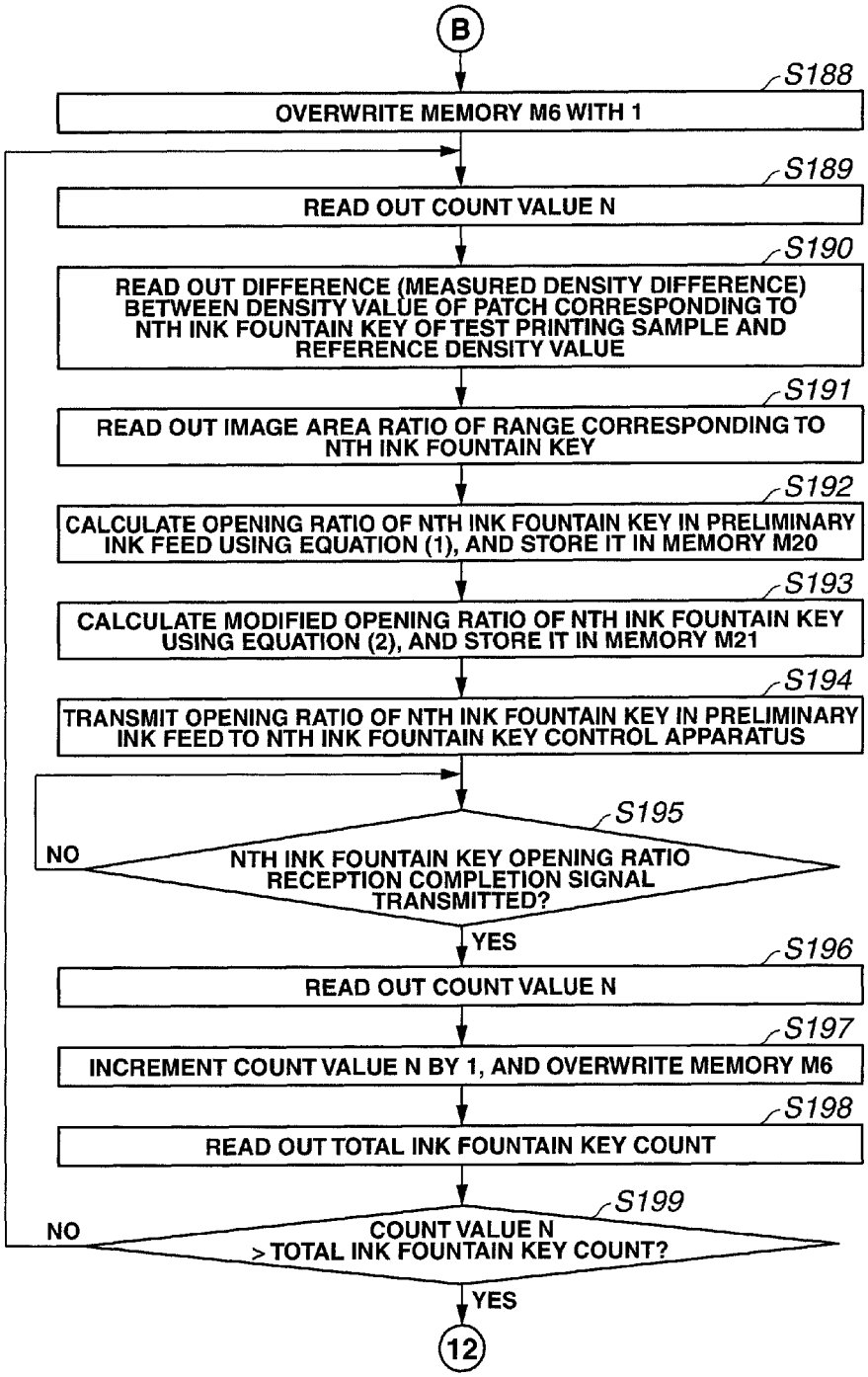
Figure 8L:
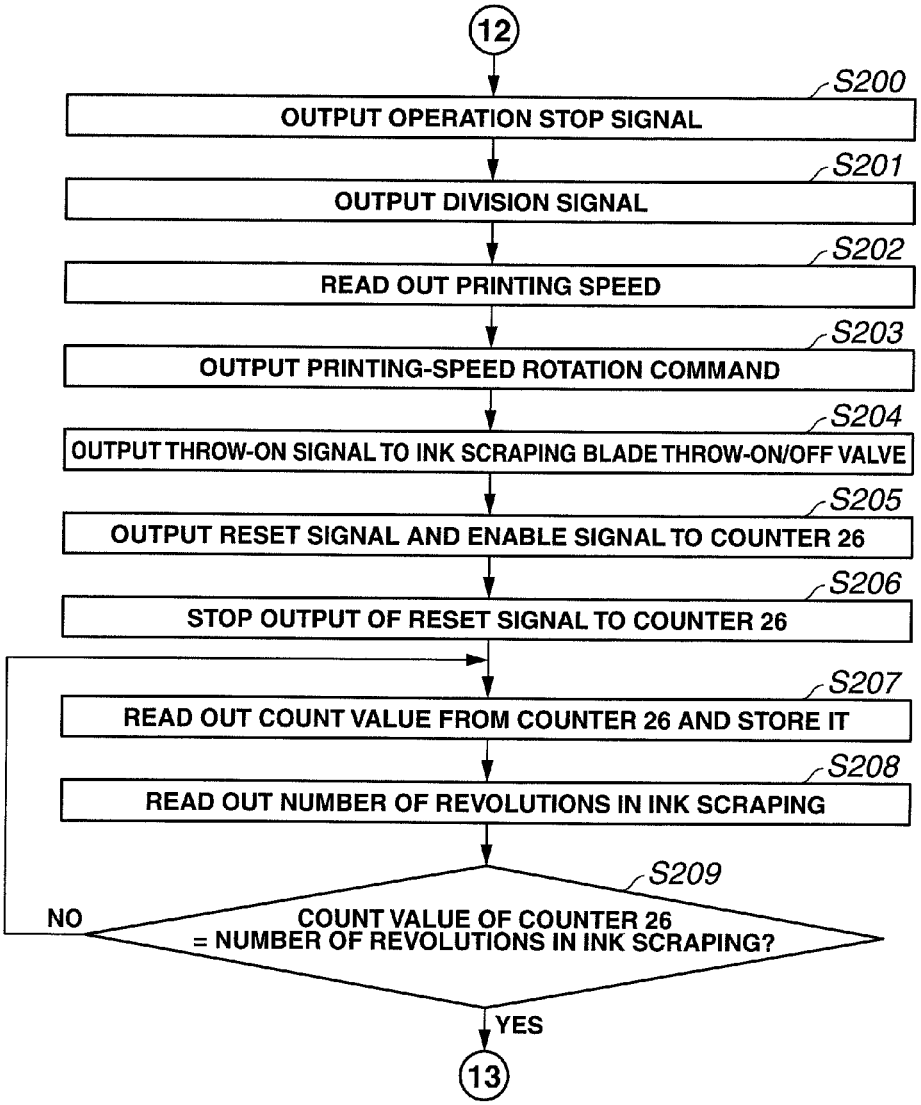
Figure 8M:
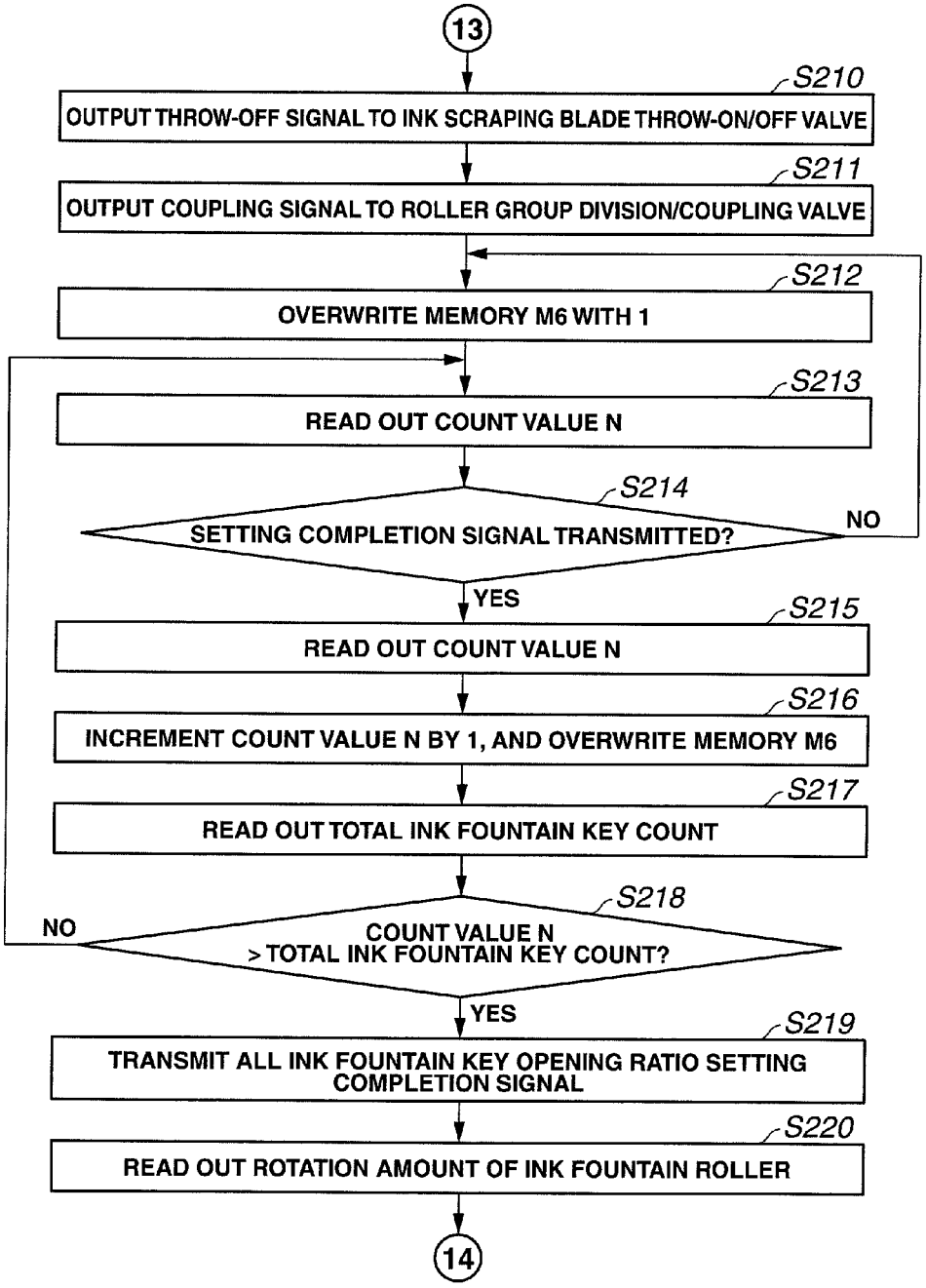
Figure 8N:
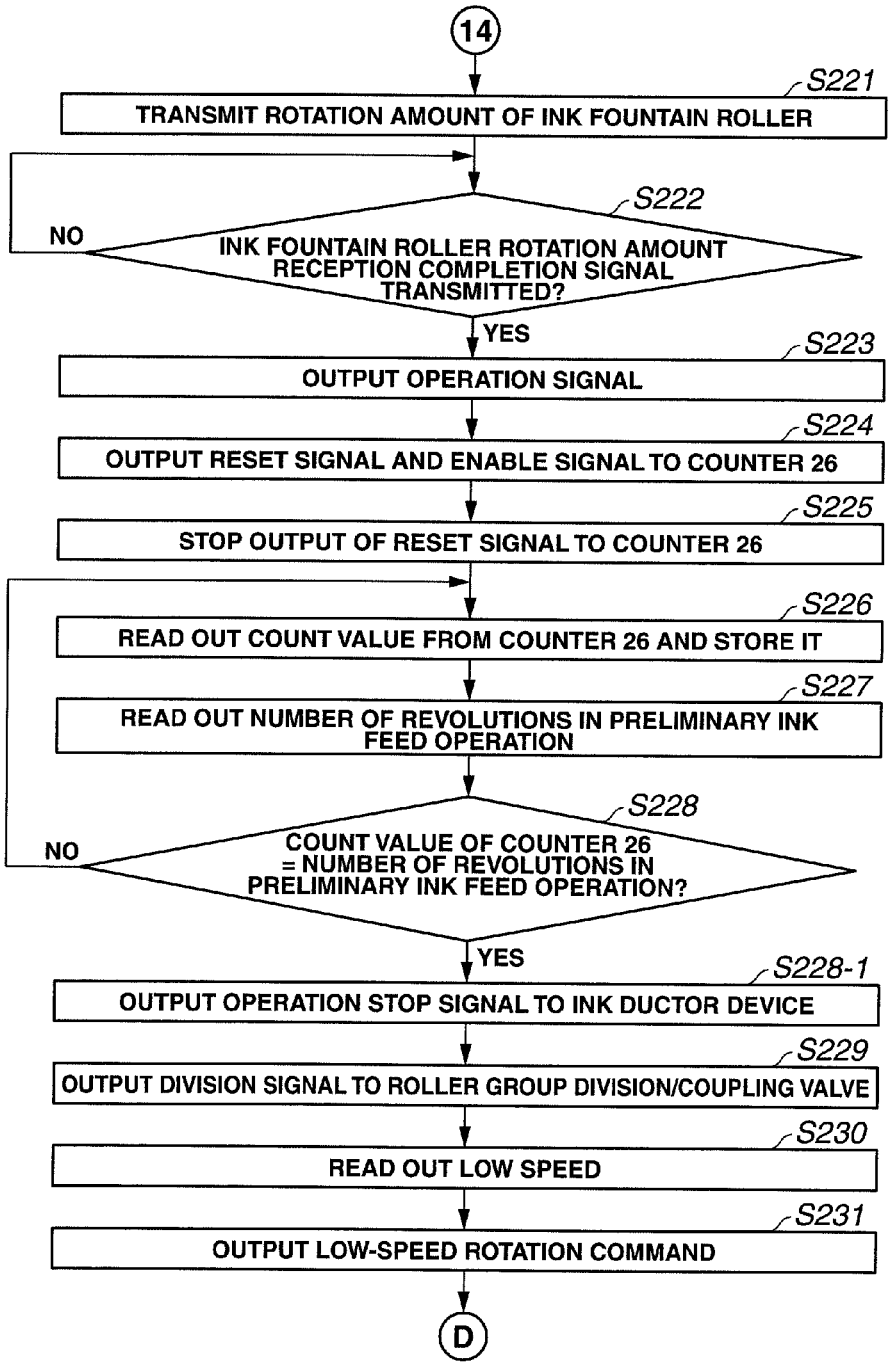
Figure 8O:
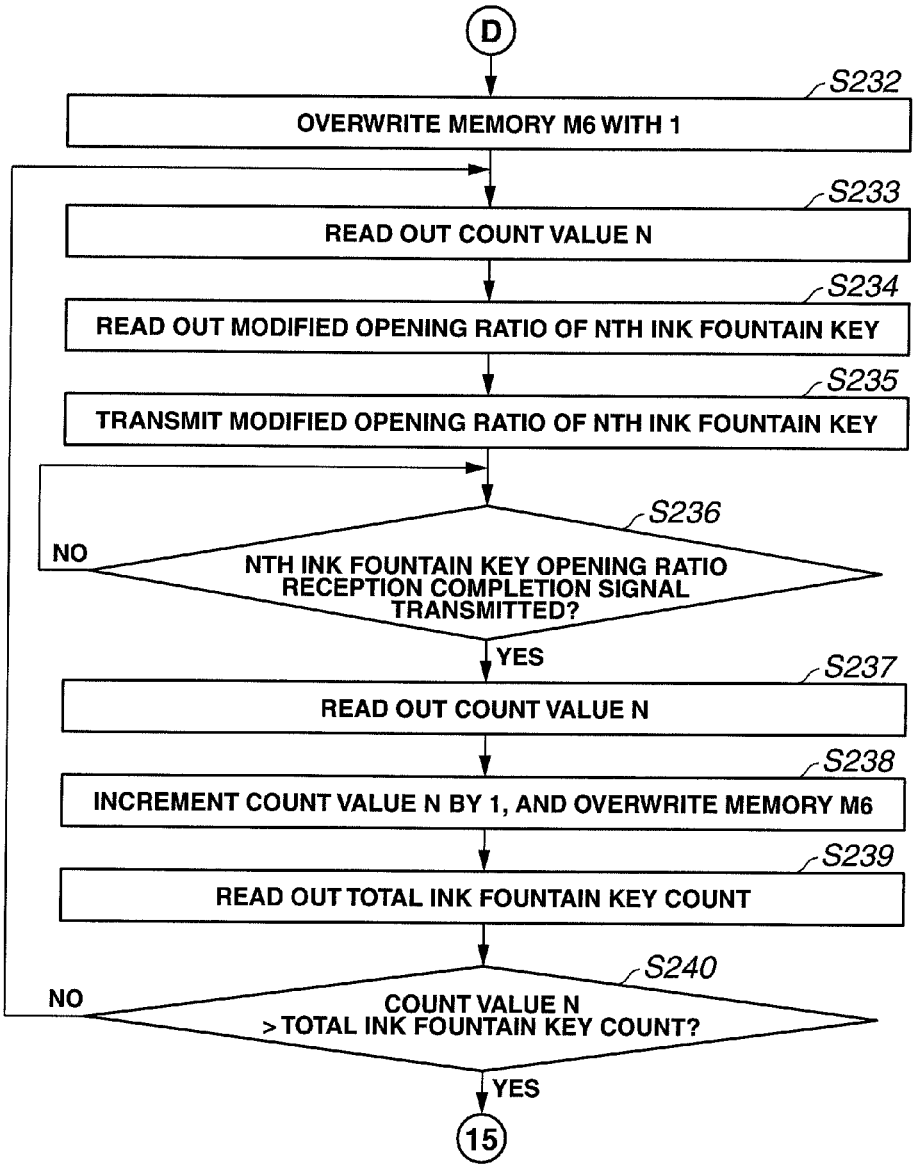
Figure 8P:
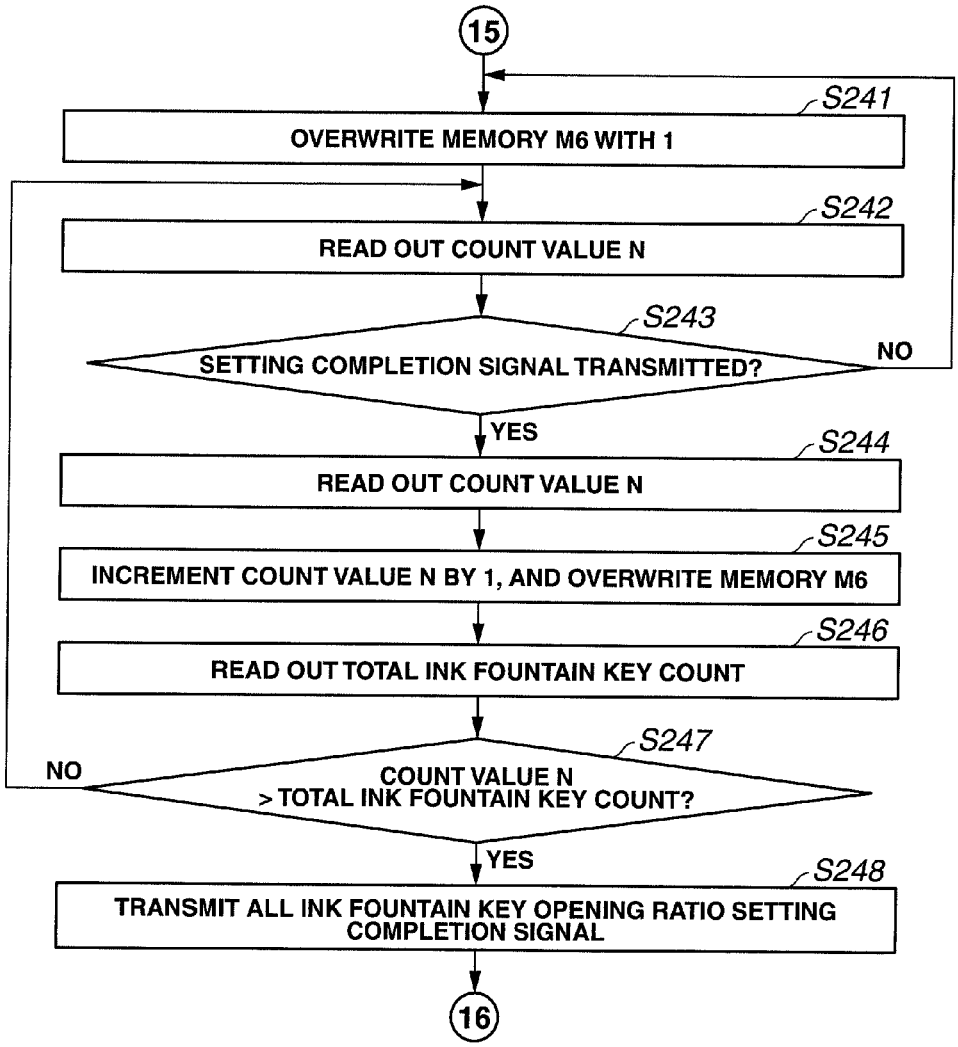
Figure 8Q:
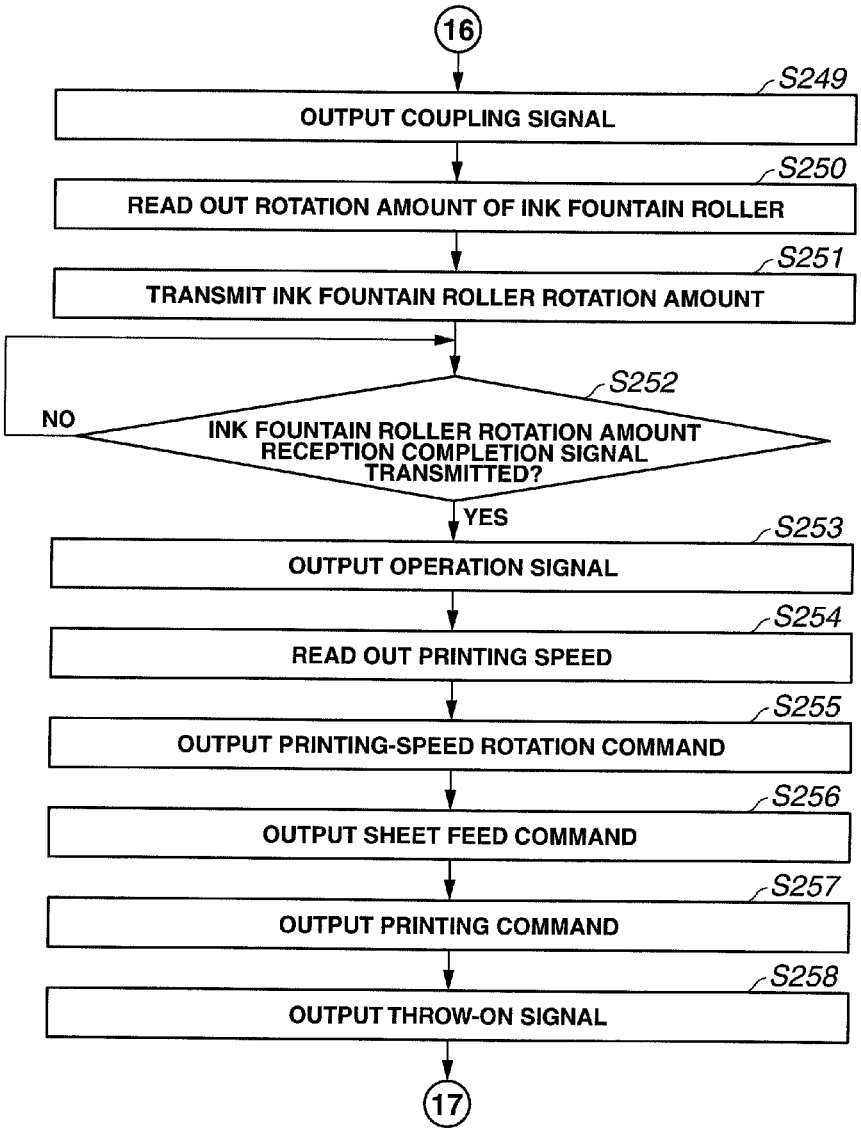
Figure 8R:
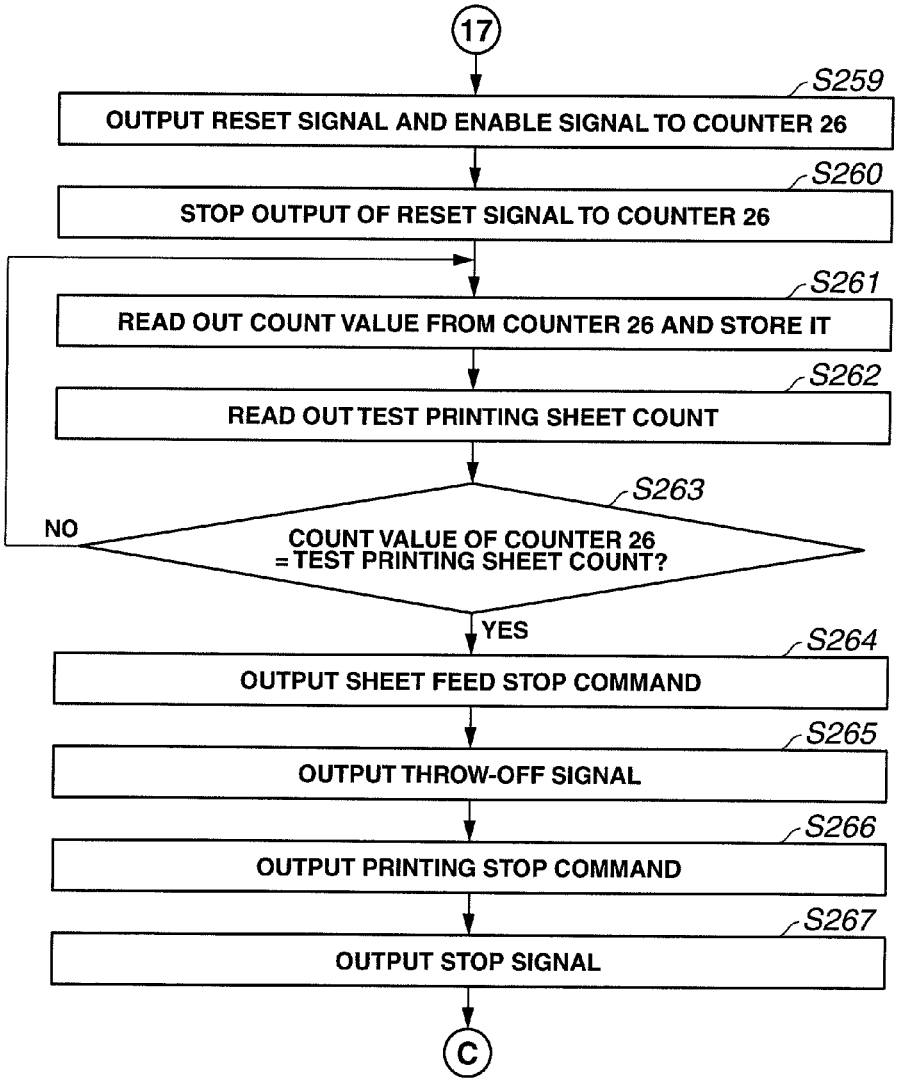

The CPU 10 continues the test reprinting until the number of revolutions of the printing press reaches the test printing sheet count Px in the memory M1 (FIG. 8R: steps S259 to S263). If the count value of the counter 26 reaches the test printing sheet count Px (YES in step S263), the CPU 10 outputs a sheet feed stop command to the sheet feeder 33 to stop sheet feed (step S264). The CPU 10 outputs a throw-off signal to the valve 36 (step S265) to throw off the ink form rollers 6-1 to 6-4. The CPU 10 outputs a printing stop command to the printing unit 34 (step S266), and outputs a stop command to the motor driver 22 (step S267) to stop the printing press.

[Final Printing]

If the density of the printing product is proper, the operator turns on the printing start switch 20. If the density of the printing product is improper, the above-described density measurement (steps S156 to S185), density modification (steps S187 to S249), and test reprinting (steps S250 to S267) are repeated.

If the printing start switch 20 has been turned on (FIG. 8G: YES in step S268), the CPU 10 reads out the rotation amount of the ink fountain roller that is stored in the memory M11 (step S269). The CPU 10 transmits the readout rotation amount of the ink fountain roller to the ink fountain roller control apparatus 200 (step S270). If the CPU 10 receives an ink fountain roller rotation amount reception completion signal from the ink fountain roller control apparatus 200 (YES in step S271), it outputs an operation signal to the ink ductor device 27 (step S272), and starts the ink feed operation of the ink ductor roller 5.

The CPU 10 reads out the printing speed Vp from the memory M5 (step S273). The CPU 10 outputs a rotation command to the motor driver 22 via the D/A converter 24 (step S274), and sets the printing speed Vp as the speed of the printing press. The CPU 10 outputs a sheet feed command to the sheet feeder 33 (step S275) to start sheet feed to the printing press. The CPU 10 outputs a printing command to the printing unit 34 (step S276). Further, the CPU 10 outputs a throw-on signal to the valve 36 (step S277) to throw on the ink form rollers 6-1 to 6-4. The CPU 10 starts printing (final printing) using the printing plate 7. Hence, final printing is performed after obtaining a satisfactory printing product by test reprinting.

[Ink Fountain Roller Control Apparatus]

Figure 9:
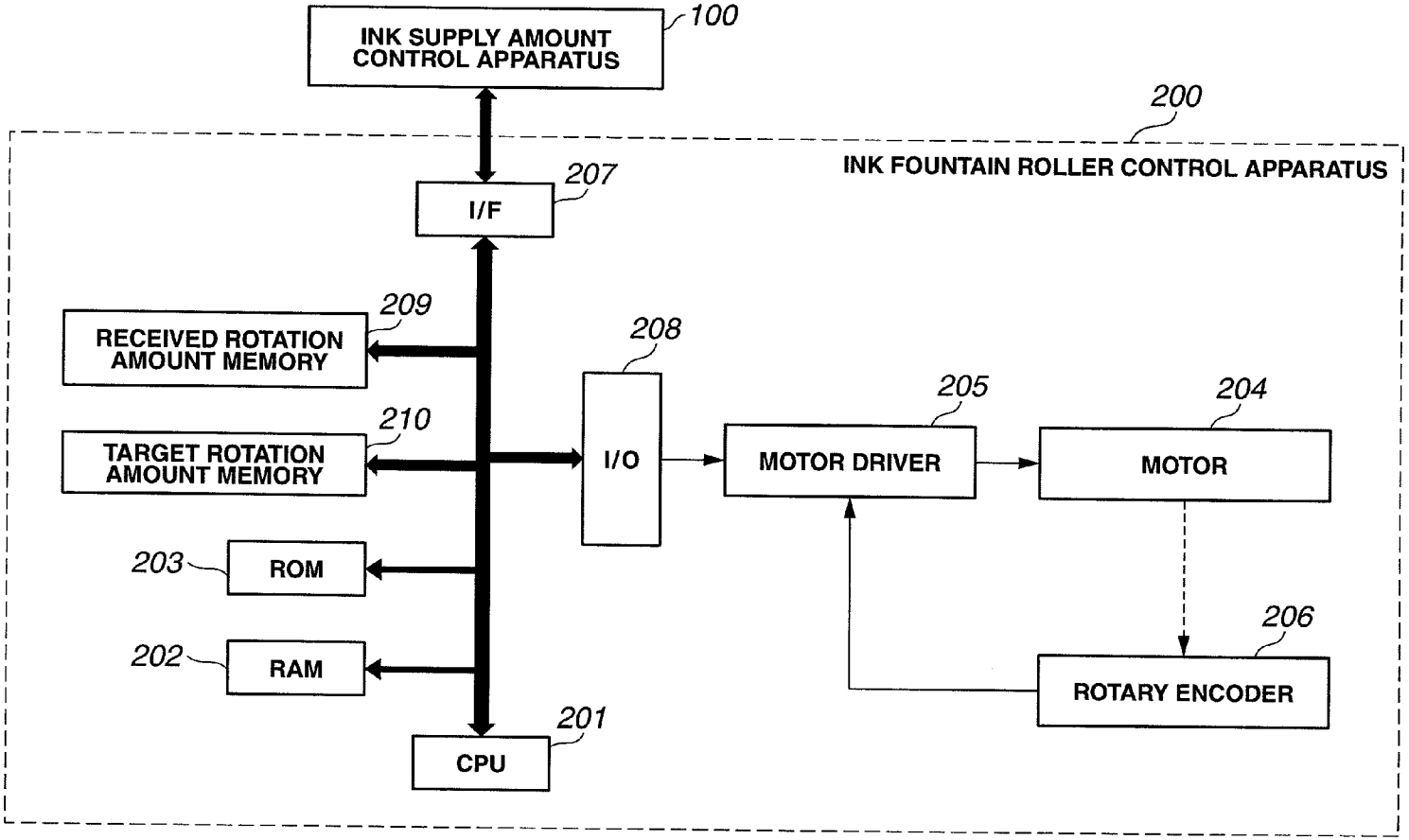
FIG. 9 is a block diagram showing the schematic internal arrangement of an ink fountain roller control apparatus.

FIG. 9 shows the schematic internal arrangement of the ink fountain roller control apparatus 200. The ink fountain roller control apparatus 200 includes a CPU 201, a RAM 202, a ROM 203, a motor 204, a motor driver 205, a rotary encoder 206, input/output interfaces (I/O I/Fs) 207 and 208, and memories 209 and 210. The ink fountain roller control apparatus 200 is connected to the ink supply amount control apparatus 100 via the interface 207. The memory 209 stores a received rotation amount of the ink fountain roller. The memory 210 stores the target feed amount of the ink fountain roller.

Figure 10:
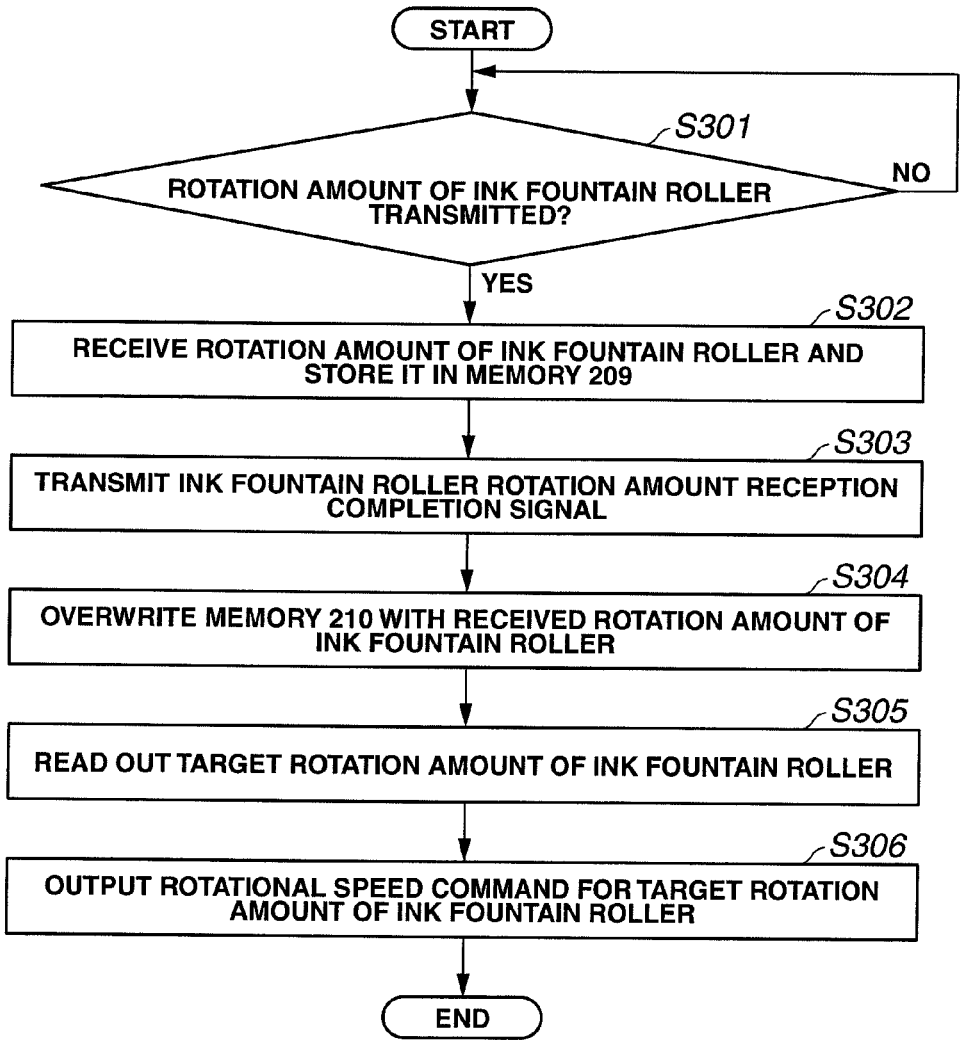
FIG. 10 is a flowchart showing the processing operation of the ink fountain roller control apparatus.

If the ink supply amount control apparatus 100 has transmitted the rotation amount of the ink fountain roller (FIG. 10: YES in step S301), the CPU 201 stores the received rotation amount in the memory 209 (step S302). The CPU 201 then transmits an ink fountain roller rotation amount reception completion signal to the ink supply amount control apparatus 100 (step S303). The CPU 201 stores the received rotation amount of the ink fountain roller as the target rotation amount of the ink fountain roller in the memory 210 (step S304). The CPU 201 reads out the target rotation amount from the memory 210 (step S305), sends it to the ink fountain roller driving motor driver 205, and adjusts the rotation amount of the ink fountain roller driving motor 204 so that it coincides with the target rotation amount (step S306).

[Ink Fountain Key Control Apparatus]

Figure 11:
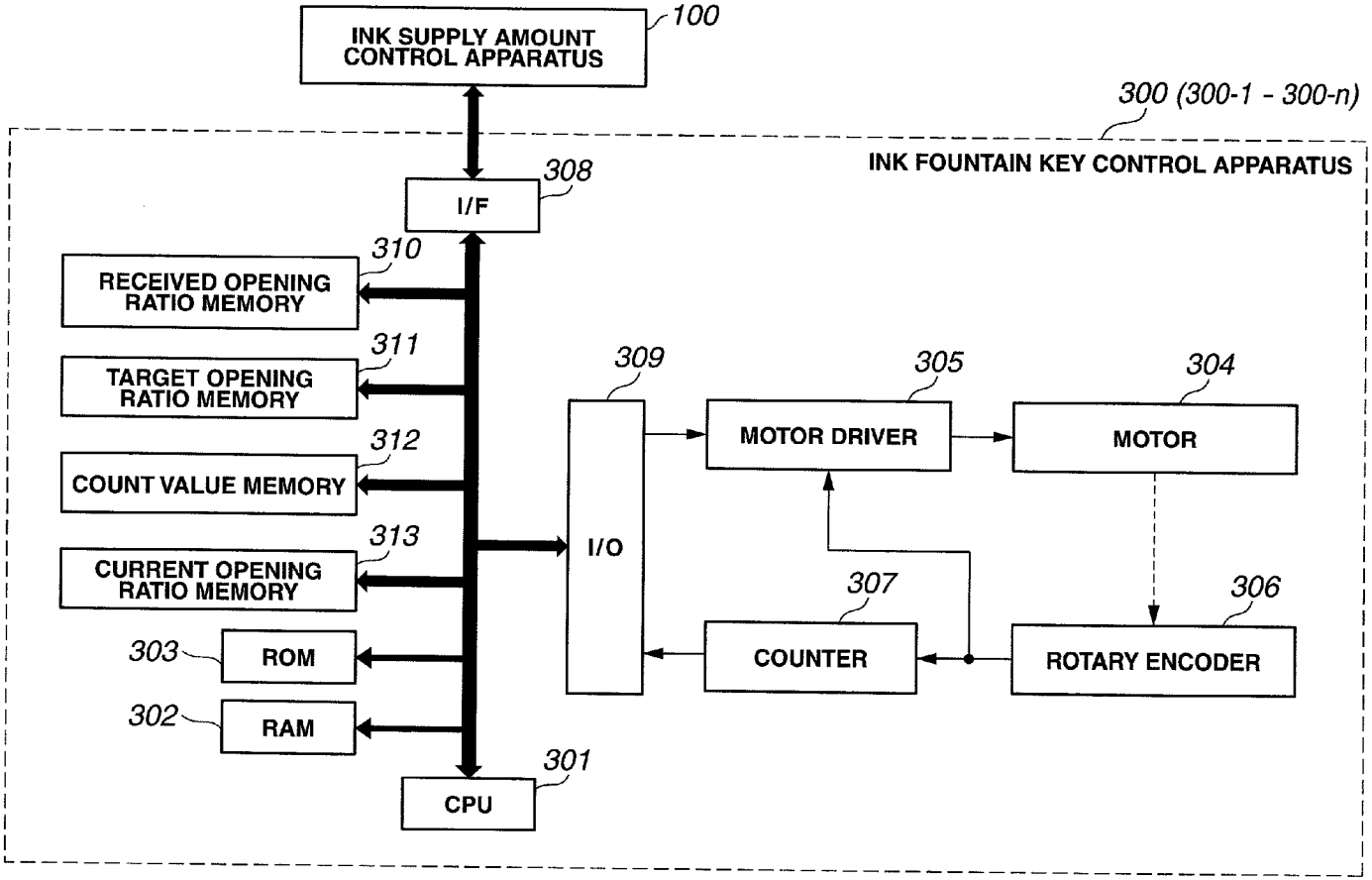
FIG. 11 is a block diagram showing the schematic internal arrangement of an ink fountain key control apparatus.

As shown in FIG. 11, the ink fountain key control apparatus 300 includes a CPU 301, a RAM 302, a ROM 303, a motor 304, a motor driver 305, a rotary encoder 306, a counter 307, input/output interfaces (I/O I/Fs) 308 and 309, and memories 310 to 313. The ink fountain key control apparatus 300 is connected to the ink supply amount control apparatus 100 via the interface 308. The memory 310 stores a received opening ratio of the ink fountain key. The memory 311 stores the target opening ratio of the ink fountain key. The memory 312 stores the count value of the counter 307. The memory 313 stores the current opening ratio of the ink fountain key.

Figure 12A:
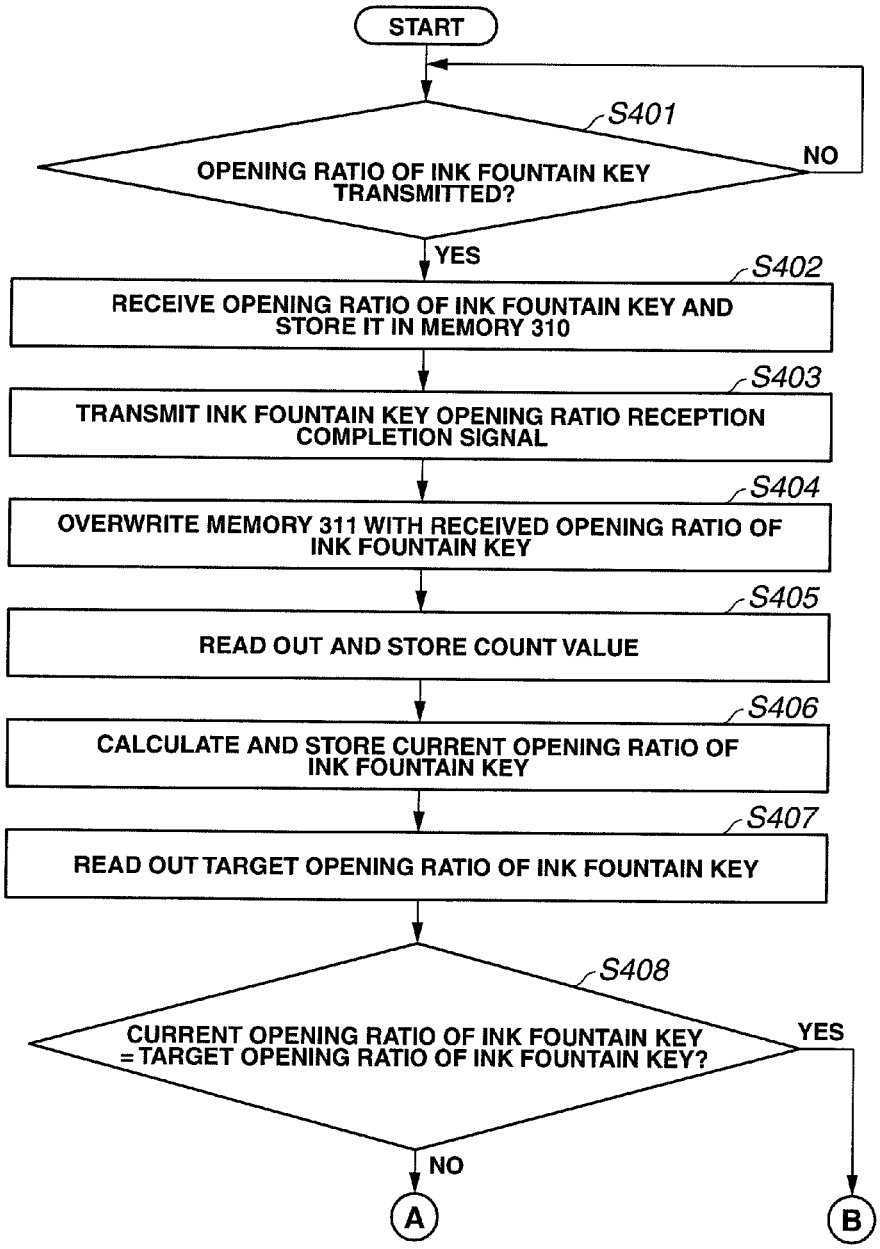
FIGS. 12A and 12B are flowcharts showing the processing operation of the ink fountain key control apparatus.

If the ink supply amount control apparatus 100 has transmitted the opening ratio of the ink fountain roller (FIG. 12A: YES in step S401), the CPU 301 stores the received opening ratio in the memory 310 (step S402). The CPU 301 then transmits an ink fountain key opening ratio reception completion signal to the ink supply amount control apparatus 100 (step S403). The CPU 301 stores the received opening ratio of the ink fountain key as a target opening ratio in the memory 311 (step S404).

Figure 12B:
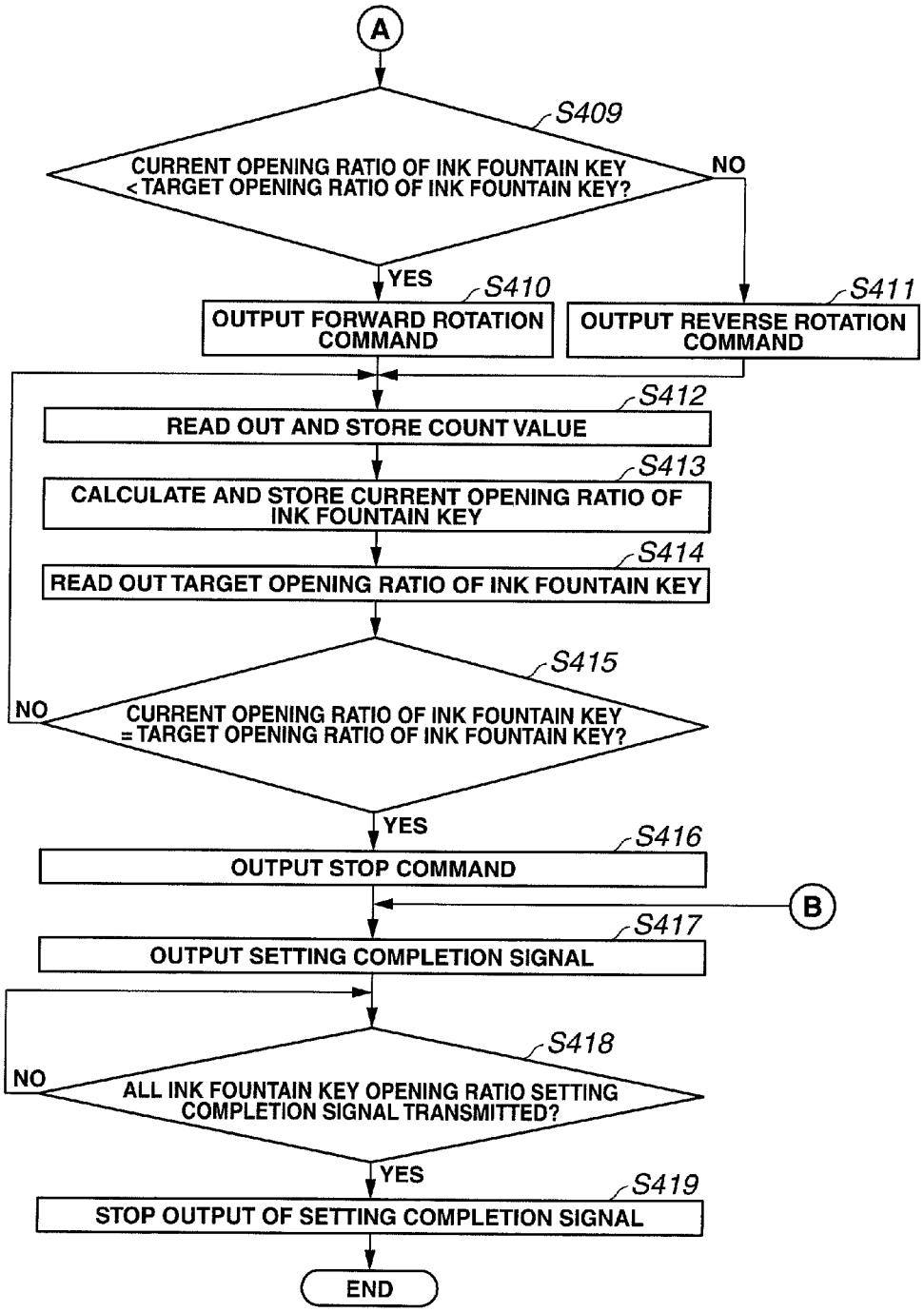

The CPU 301 reads the count value of the counter 307 and stores it in the memory 312 (step S405). The CPU 301 obtains the current opening ratio of the ink fountain key from the read count value of the counter 307, and stores it in the memory 313 (step S406). The CPU 301 reads out the target opening ratio of the ink fountain key from the memory 311 (step S407). If the current opening ratio of the ink fountain key is equal to the target opening ratio (YES in step S408), the process directly advances to step S417 (FIG. 12B). The CPU 301 outputs an ink fountain key opening ratio setting completion signal to the ink supply amount control apparatus 100.

If the current opening ratio of the ink fountain key is different from the target opening ratio (NO in step S408), the CPU 301 drives the ink fountain key driving motor 304, until the current opening ratio of the ink fountain key becomes equal to the target opening ratio (FIG. 12B: steps S409 to S416). After that, the CPU 301 outputs an ink fountain key opening ratio setting completion signal to the ink supply amount control apparatus 100 (step S417).

More specifically, if the current opening ratio of the ink fountain key is lower than the target opening ratio (YES in step S409), the CPU 301 sends a forward rotation command to the ink fountain key driving motor driver 305 (step S410). The CPU 301 reads out the count value from the counter 307 (step S412), and calculates the current opening ratio of the ink fountain key from the count value (step S413). The CPU 301 reads out the target opening ratio of the ink fountain key from the memory 311 (step S414). The CPU 301 repeats the processing operations in steps S412 to S415 until the current opening ratio of the ink fountain key coincides with the target opening ratio of the ink fountain key (YES in step S415).

If the current opening ratio of the ink fountain key is higher than the target opening ratio (NO in step S409), the CPU 301 sends a reverse rotation command to the ink fountain key driving motor driver 305 (step S411). The CPU 301 reads out the count value from the counter 307 (step S412), and calculates the current opening ratio of the ink fountain key from the count value (step S413). The CPU 301 reads out the target opening ratio of the ink fountain key from the memory 311 (step S414). The CPU 301 repeats the processing operations in steps S412 to S415 until the current opening ratio of the ink fountain key coincides with the target opening ratio of the ink fountain key (YES in step S415).

If the current opening ratio of the ink fountain key coincides with the target opening ratio of the ink fountain key in step S415 (YES in step S415), the CPU 301 outputs a stop command to the ink fountain key driving motor driver 305 (step S416), and outputs an ink fountain key opening ratio setting completion signal to the ink supply amount control apparatus 100 (step S417).

After outputting the ink fountain key opening ratio setting completion signal to the ink supply amount control apparatus 100 (step S417), the CPU 301 stops the output of the ink fountain key opening ratio setting completion signal to the ink supply amount control apparatus 100 (step S419) upon receiving an all ink fountain key opening ratio setting completion signal from the ink supply amount control apparatus 100 (YES in step S418).

In the above-described embodiment, in step S192 (FIG. 8K), the opening ratio $\theta_N'$ of each ink fountain key in preliminary ink feed is calculated using the image area ratio $S_N$ of a range corresponding to the ink fountain key, as represented by equation (1) described above. Instead of the image area ratio $S_N$ of a range corresponding to each ink fountain key, the image area of a range corresponding to each ink fountain key may be used. Alternatively, the current opening ratio of each ink fountain key may be used.

In step S193 (FIG. 8K), the modified opening ratio (opening ratio in printing after preliminary ink feed) $\theta_N''$ of each ink fountain key is calculated using the image area ratio $S_N$ of a range corresponding to the ink fountain key, as represented by equation (2) described above. Instead of the image area ratio $S_N$ of a range corresponding to each ink fountain key, the image area of a range corresponding to each ink fountain key may be used. Also, the current opening ratio of each ink fountain key may be used.

For example, when the current opening ratio of each ink fountain key is used, the current opening ratio of the ink fountain key is defined as $\theta_N$, and the opening ratio $\theta_N'$ of each ink fountain key in preliminary ink feed is calculated using equation (3):

$$\theta_N'=\alpha\cdot\Delta D_N\cdot\theta_N\cdot\beta \quad (3)$$

Further, the modified opening ratio (opening ratio in printing after preliminary ink feed) $\theta_N''$ of each ink fountain key is calculated using equation (4):

$$\theta_N''=\theta_N-\alpha\cdot\Delta D_N\cdot\theta_N \quad (4)$$

In the above-described embodiment, the ink removal device formed from the ink scraping blade 30 and ink receiver 52 is arranged for the upstream roller subgroup 6A. However, the present invention is not limited to this, and ink in the upstream roller subgroup 6A may be removed by, for example, scraping ink by a scraper.

In the above-described embodiment, the ink roller group 6 is divided into the two, upstream roller subgroup 6A and downstream roller subgroup 6B (strictly speaking, into three, including the roller 6C). However, the ink roller group 6 may be divided into a larger number of roller subgroups such as three or four. Although ink in some of the divided roller subgroups is removed, ink may be removed from a plurality of roller subgroups as long as these roller subgroups are some of the divided roller subgroups.

In the above-described embodiment, the ink roller group 6 is divided and coupled using the swing arm 51. However, the mechanism of dividing and coupling the ink roller group 6 is not limited to the mechanism using the swing arm.

In the above-described embodiment, the ink film thickness distribution of the ink roller group 6 is corrected during test printing. However, the ink film thickness distribution of the ink roller group 6 can be corrected in the same manner even during final printing.

According to the present invention, while the ink form rollers are thrown off during test printing or final printing, and the ink feed operation of the ink ductor roller is stopped, the ink roller group is divided into a plurality of roller subgroups. Then, ink in some of the divided roller subgroups is removed by a blade or scraper. Although the ink roller group is divided into a plurality of roller subgroups in the present invention, the number of roller subgroups is arbitrary such as two or more. Although ink in some of the divided roller subgroups is removed in the present invention, ink may be removed from a plurality of roller subgroups as long as these roller subgroups are some of the divided roller subgroups.

In an arrangement capable of dividing the ink roller group into two roller subgroups, the ink roller group is divided into upstream and downstream roller subgroups. Ink is removed from some of the divided roller subgroups, e.g., the upstream roller subgroup. In this case, the ink in the upstream roller subgroup cannot be returned to the ink fountain because the ink feed operation of the ink ductor roller stops. Since the upstream roller subgroup is disconnected from the downstream roller subgroup, the ink cannot be removed by blank sheet printing. In the present invention, therefore, the ink in the upstream roller subgroup is removed not by "ink return to fountain" or blank sheet printing, but scraped by the blade or scraper.

In the arrangement capable of dividing the ink roller group into two roller subgroups, the upstream and downstream roller subgroups are coupled and returned to the single ink roller group. While an opening ratio in preliminary ink feed is set as the opening ratio of each ink fountain key, the ink feed operation of the ink ductor roller is performed by a predetermined number of times, forming an ink film thickness distribution in preliminary ink feed in the single returned roller group.

In the arrangement capable of dividing the ink roller group into two roller subgroups, the upstream and downstream roller subgroups are coupled and returned to the single ink roller group. After the ink film thickness distribution in preliminary ink feed is formed in the single coupled roller group, an opening ratio in printing after preliminary ink feed is set as the opening ratio of each ink fountain key. In this state, the ink form rollers are thrown on to restart printing using the printing plate. Thus, the ink film thickness distribution is modified quickly by preliminary ink feed. After that, the opening ratio is returned to the opening ratio in printing after preliminary ink feed, and a proper printing product can be printed quickly.

What is claimed is:

1. An ink film thickness distribution correction method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group including at least one ink form roller which receives the ink transferred to the ink ductor roller and supplies the ink to a printing plate, comprising the steps of:

performing a throw-off operation of the ink form roller positioned at an end of the ink roller group during test printing or final printing;

stopping the ink feed operation of the ink ductor roller during test printing or final printing;

dividing the ink roller group into a plurality of roller subgroups during test printing or final printing; and scraping and removing the ink in some roller subgroups out of the divided roller subgroups by an ink scraping member.

2. A method according to claim 1, further comprising the steps of:

measuring density values of density measurement patches printed in ranges corresponding to the plurality of ink fountain keys on a printing sheet before an ink removal operation;

obtaining opening ratios of the plurality of ink fountain keys in preliminary ink feed based on differences between the measured density values of the density measurement patches and preset reference density values, and image area ratios of the ranges corresponding to the plurality of ink fountain keys;

setting the obtained opening ratios in preliminary ink feed for the plurality of ink fountain keys;

after removing the ink in some roller subgroups, coupling the divided roller subgroups and returning the divided roller subgroups to the single ink roller group; and after returning the roller subgroups to the single ink roller group and setting the opening ratios in preliminary ink feed for the plurality of ink fountain keys, forming an ink film thickness distribution in preliminary ink feed in the single returned ink roller group by performing the ink feed operation of the ink ductor roller by a predetermined number of times.

3. A method according to claim 2, further comprising the steps of:

obtaining opening ratios of the plurality of ink fountain keys in printing after preliminary ink feed based on the differences between the measured density values of the density measurement patches and the preset reference density values, and the image area ratios of the ranges corresponding to the plurality of ink fountain keys;

setting the opening ratios in printing after preliminary ink feed for the plurality of ink fountain keys; and after forming an ink film thickness distribution in preliminary ink feed in the ink roller group and setting the opening ratios in printing after preliminary ink feed for the plurality of ink fountain keys, restarting printing using the printing plate by performing a throw-on operation of the ink form roller.

* * * * *